US011745087B1

(12) United States Patent
Jennings et al.

(10) Patent No.: US 11,745,087 B1
(45) Date of Patent: Sep. 5, 2023

(54) KIT FOR INCREASING THE GROUND CLEARANCE OF A MOTORIZED SKATEBOARD

(71) Applicants: Bradley Allan Jennings, Highland Village, TX (US); Luke Jan Andraski, Denton, TX (US); Austin Lloyd Walters, N. Richland Hills, TX (US)

(72) Inventors: Bradley Allan Jennings, Highland Village, TX (US); Luke Jan Andraski, Denton, TX (US); Austin Lloyd Walters, N. Richland Hills, TX (US)

( * ) Notice: Subject to any disclaimer, the term of this patent is extended or adjusted under 35 U.S.C. 154(b) by 0 days.

(21) Appl. No.: 17/525,138

(22) Filed: Nov. 12, 2021

Related U.S. Application Data

(60) Provisional application No. 63/212,691, filed on Jun. 20, 2021.

(51) Int. Cl.

| | |
|---|---|
| ***A63C 17/00*** | (2006.01) |
| ***A63C 17/02*** | (2006.01) |
| ***A63C 17/26*** | (2006.01) |
| ***A63C 17/08*** | (2006.01) |

(52) U.S. Cl.
CPC ..... *A63C 17/26* (2013.01); *A63C 17/08* (2013.01)

(58) Field of Classification Search
CPC ..... A63C 17/26; A63C 17/12; A63C 17/08
See application file for complete search history.

(56) References Cited

U.S. PATENT DOCUMENTS

| | | | | |
|---|---|---|---|---|
| 7,811,217 | B2 * | 10/2010 | Odien | A63C 17/12 482/34 |
| 9,962,597 | B2 * | 5/2018 | Doerksen | B62K 25/00 |
| 10,010,784 | B1 * | 7/2018 | Doerksen | A63C 17/0046 |
| 10,112,680 | B2 * | 10/2018 | Doerksen | H02K 1/20 |
| 11,033,800 | B2 * | 6/2021 | Sullivan | A63C 17/262 |
| 11,325,021 | B1 * | 5/2022 | McCosker | A63C 17/12 |
| 11,406,890 | B1 * | 8/2022 | Jackson | A63C 17/12 |
| 2006/0012141 | A1 * | 1/2006 | Bouvet | A63C 17/12 280/87.042 |

* cited by examiner

*Primary Examiner* — Brian L Swenson
(74) *Attorney, Agent, or Firm* — Jeffrey Roddy

(57) ABSTRACT

A lift kit assembly includes a pair of axle cup bracket portions each adapted to accept an axle end and adjustably mount to a side rail or frame of a motorized skateboard on either side of a wheel whereby the axle of a motorized skateboard may be lowered or raised as desired by a user.

2 Claims, 31 Drawing Sheets

KIT FOR INCREASING THE GROUND CLEARANCE OF A MOTORIZED SKATEBOARD

CROSS REFERENCES TO RELATED APPLICATIONS

This Non-Provisional Application claims priority benefit to U.S. Provisional Application No. 63/212,691 filed Jun. 20, 2021, entitled "Kit for Increasing the Ground Clearance of a Motorized Skateboard."

TECHNICAL FIELD

The invention relates generally to motorized skateboards and modifications and improvements of same.

BACKGROUND

Motorized skateboards are increasingly popular personal transportation and recreation devices that allow a rider to perform maneuvers that are not possible with other modes of transport. While the motorized skateboards are most frequently used on roadways or sidewalks, many riders enjoy their use on non-paved trails that may have a number of obstacles and uneven terrain.

Accordingly, it would be desirable to provide a lift assembly kit that would permit the modification of a motorized skateboard such that the ground clearance of the skateboard is increased without deprecating the maneuvering capability of the board.

It would be desirable if such a lift assembly were easy to retrofit to existing motorized boards without damaging the board.

It would be further desirable if such a lift assembly were easily removable so that the motorized skateboard could be restored to its original configuration if desired.

Alternately, it would be especially desirable if such a lift assembly might be adapted, depending on rider preferences, to enable the lowering of the riding platform of a motorized skateboard providing a lower center of gravity.

SUMMARY

In a general example implementation of the present invention, a lift kit assembly for a motorized skateboard includes a pair of axle cup supports, each of the axle cup supports include an axle cup mounting portion and a frame mounting portion.

In an aspect combinable with any other aspect described herein, an axle cup mounting portion of each of the axle cup supports is adapted to reside below the original equipment OE frame of the motorized skateboard.

In an aspect combinable with any other aspect described herein, the frame mounting portion of each of the axle cup supports is adapted to fit to the outer surface of the OE frame of the motorized skateboard.

In an aspect combinable with any other aspect described herein, an axle cup mounting portion of each of the axle cup supports is adapted to reside substantially flush with an inside surface of the OE frame that faces the in OE cup.

In an aspect combinable with any other aspect described herein, an axle cup mounting portion of each of the axle cup supports include a fastener mount for fastening the OE axle cup or substitute thereto, such that the revised position of the axle cup is below its original position on the OE frame member.

In an aspect combinable with any other aspect described herein, repositioning of the axle cup so that it is mounted inferior to the original mounting position raises the riding platform relative to a ground surface.

In an aspect combinable with any other aspect described herein, repositioning of the axle cup so that it is mounted superior to the original mounting position lowers the riding platform relative to a ground surface.

In an aspect combinable with any other aspect described herein, during installation of the lift kit, OE wiring bundles may be repositioned without deprecating any functionality of the motorized skateboard.

In another general implementation of the present invention, a lift kit assembly for a motorized skateboard includes a pair of axle cup supports, each of the axle cup supports include an axle cup portion, an axle cup mounting portion and a frame mounting portion.

In an aspect combinable with any other aspect described herein, the axle cup mounting portion may include one or more interlocking elements.

In an aspect combinable with any other aspect described herein, the axle cup mounting portion is mountable to a frame rail of a motorized skateboard.

In an aspect combinable with any other aspect described herein, the axle cup includes an integrated channel to guide a battery-to-motor power cable of a motorized skateboard.

Other advantages of the present invention will become apparent from the following descriptions, taken in connection with the accompanying drawings wherein by way of illustration and example, preferred embodiments of the present invention are disclosed.

BRIEF DESCRIPTION OF THE DRAWING FIGURES

Figure 13:
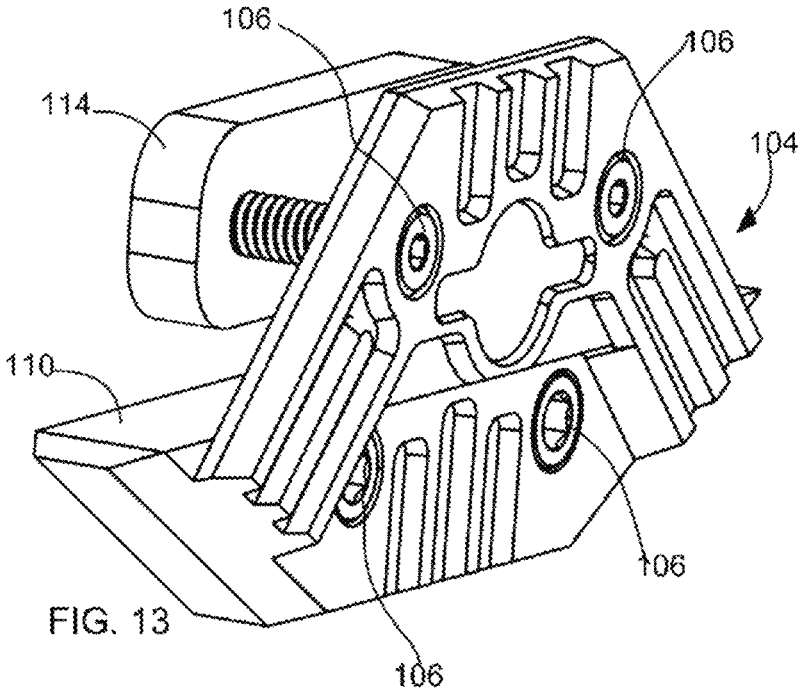
Figure 14:
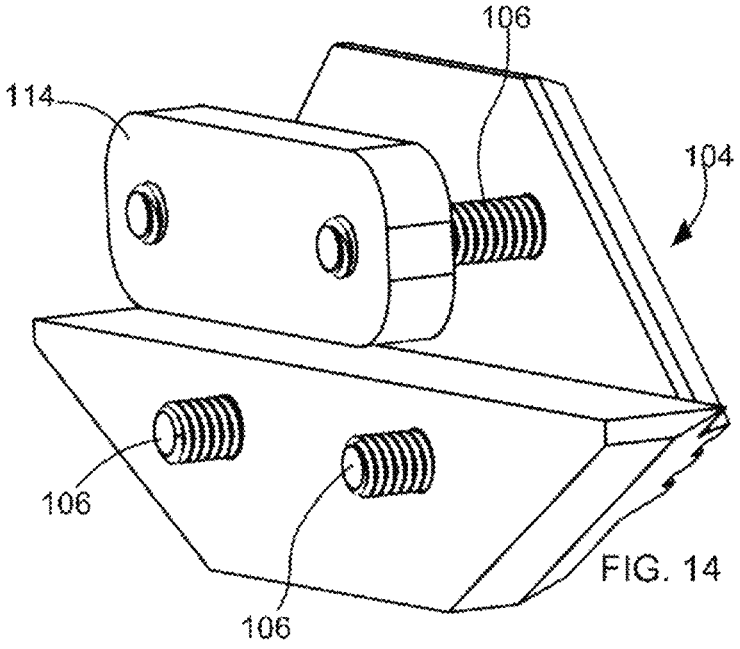
Figure 15:
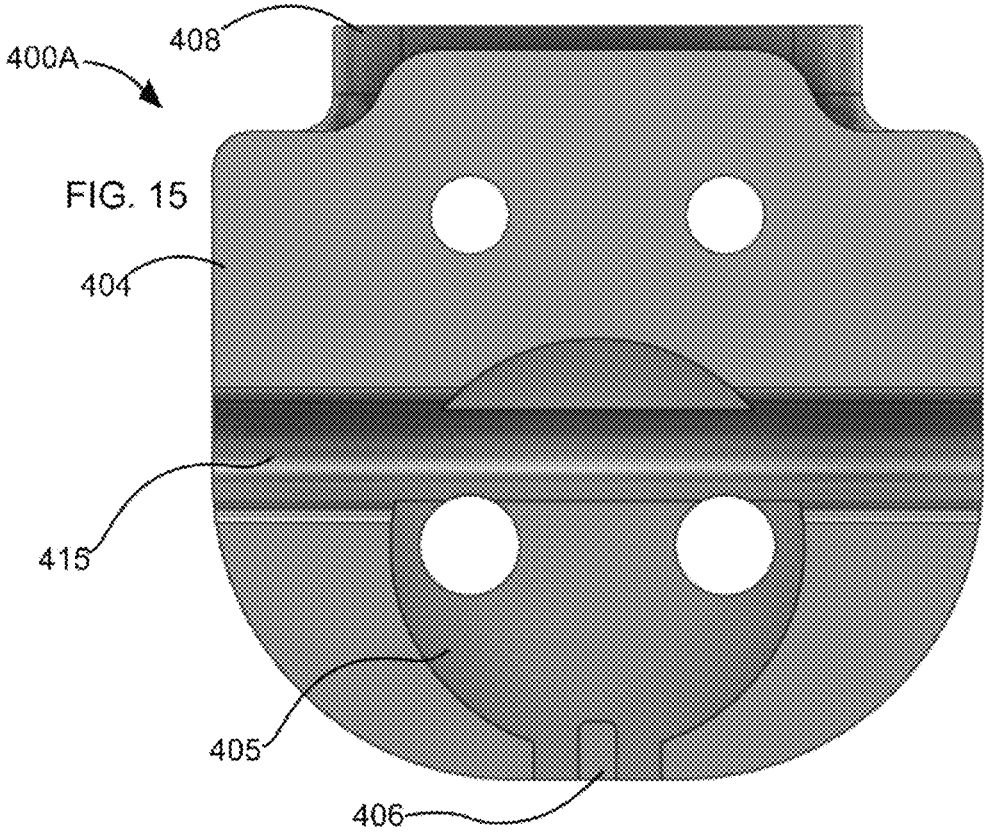
Figure 16:
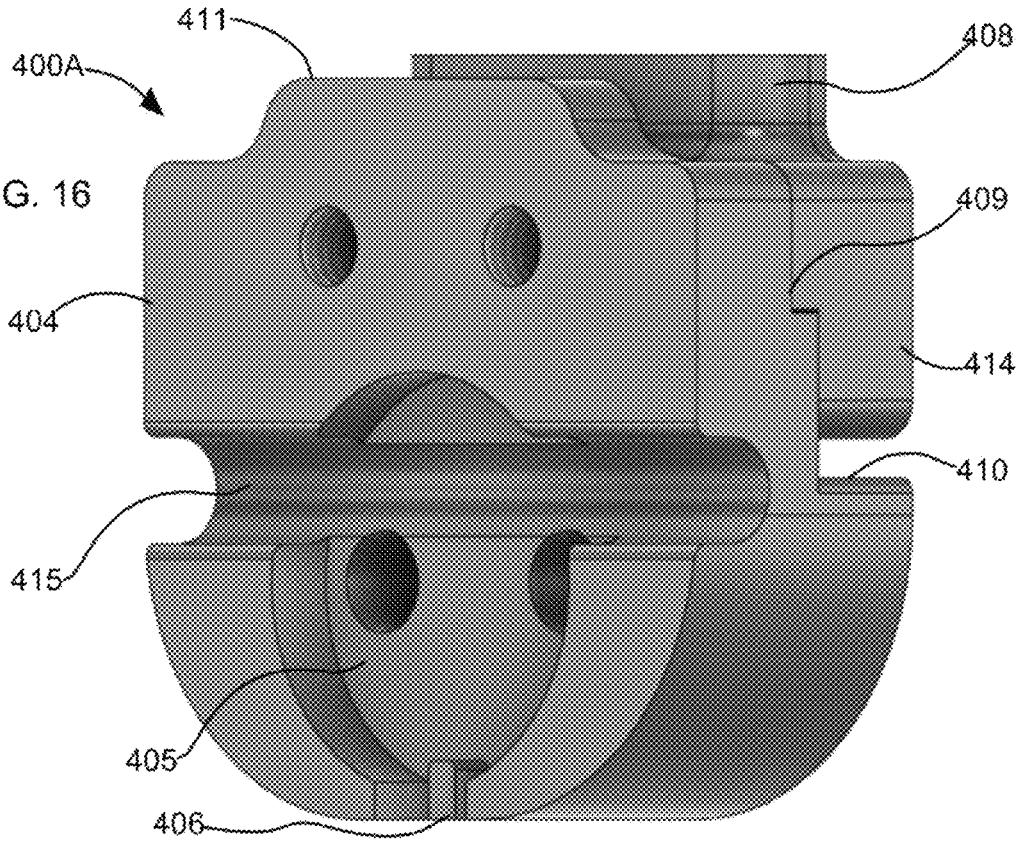
Figure 17:
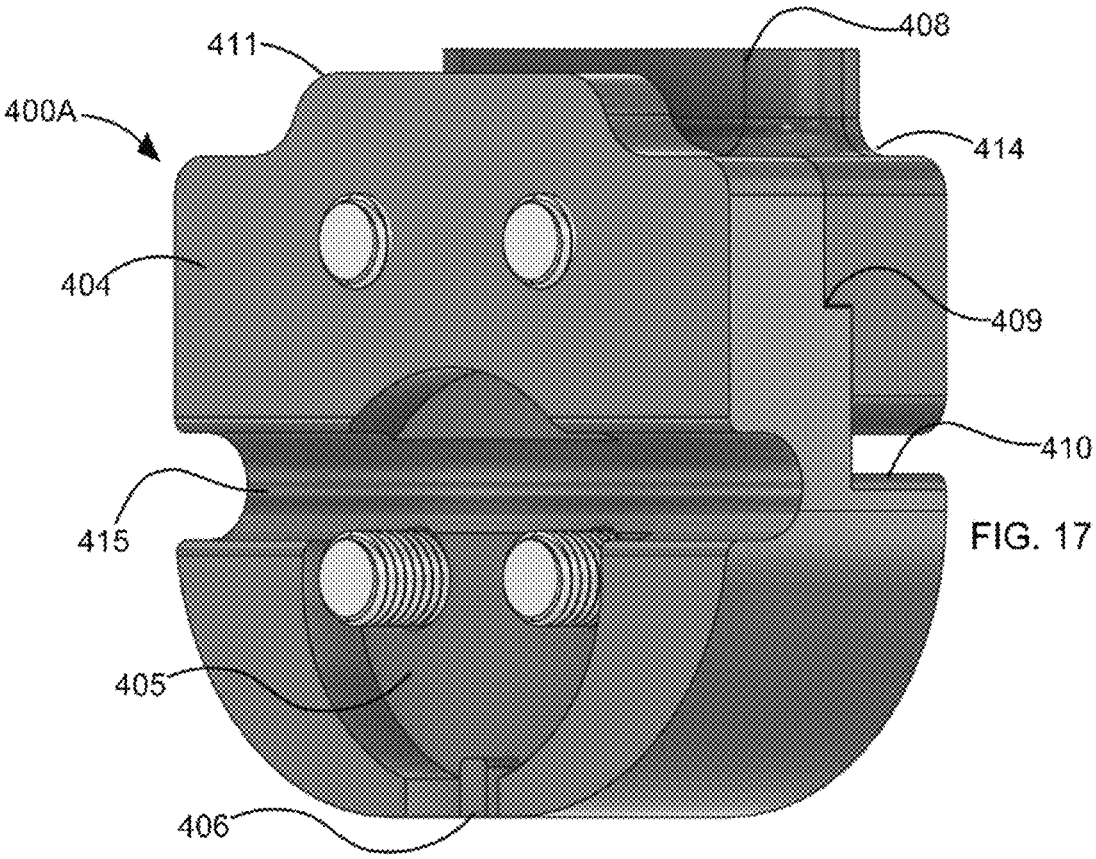
Figure 18:
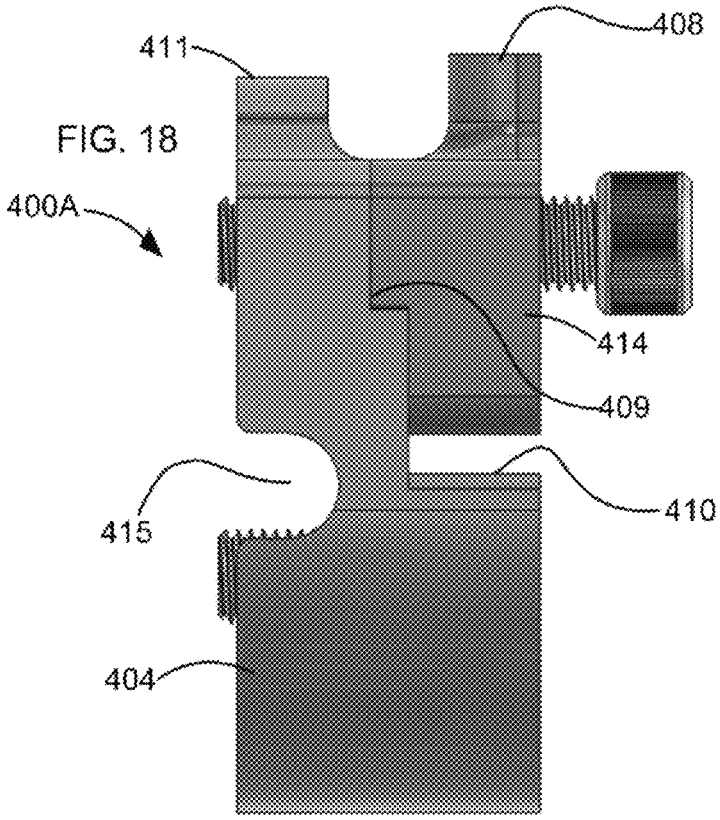
Figure 19:
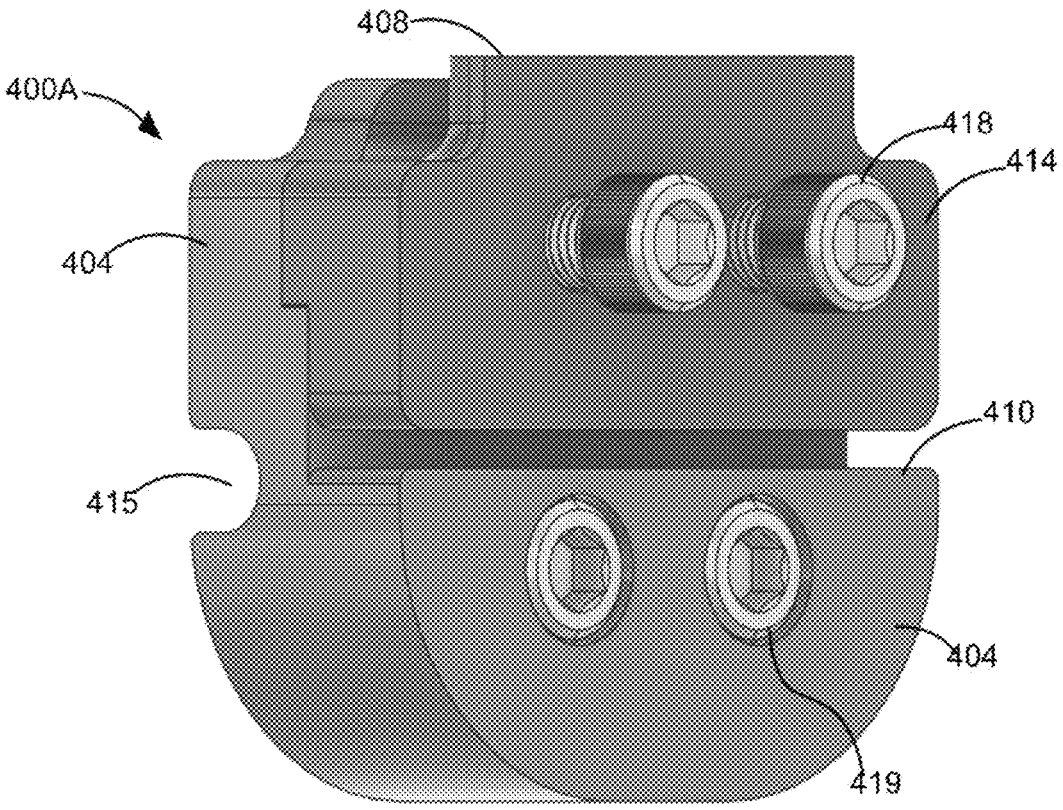
Figure 20:
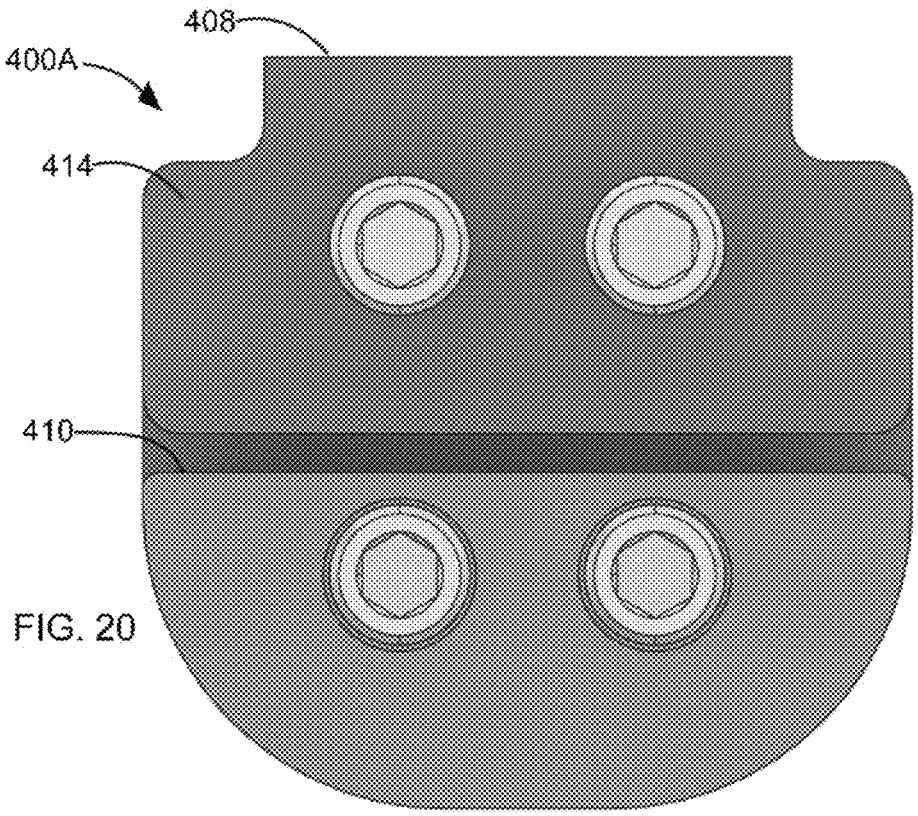
Figure 21:
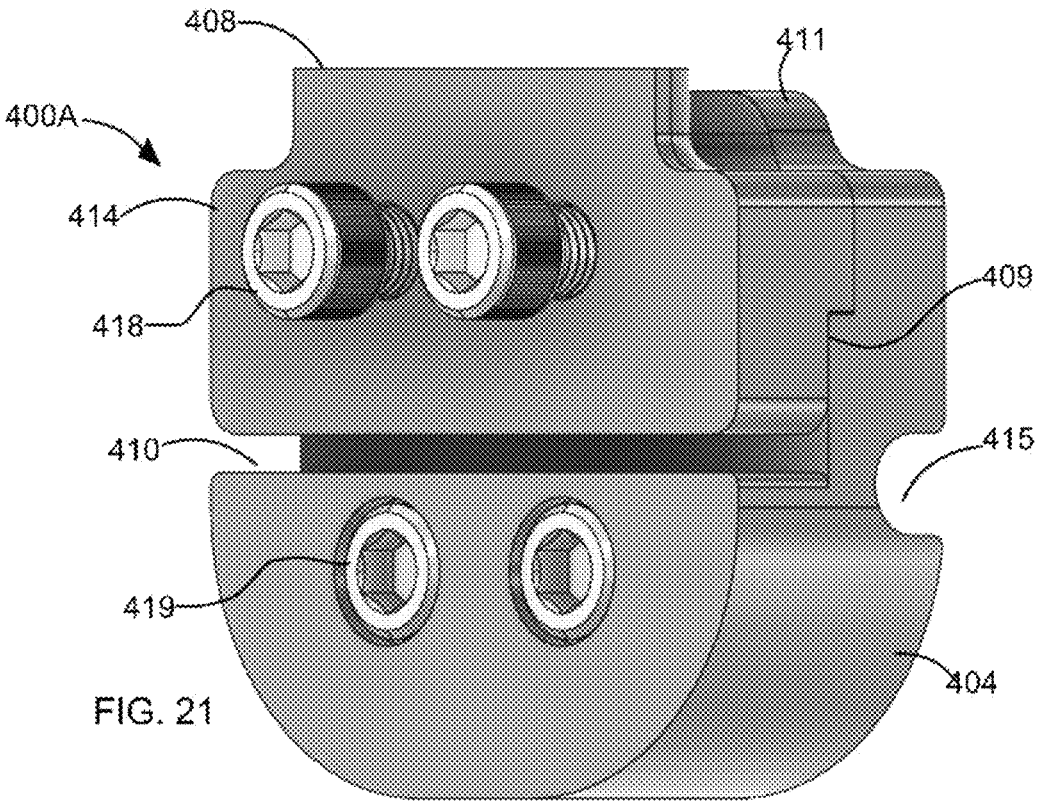
Figure 22:
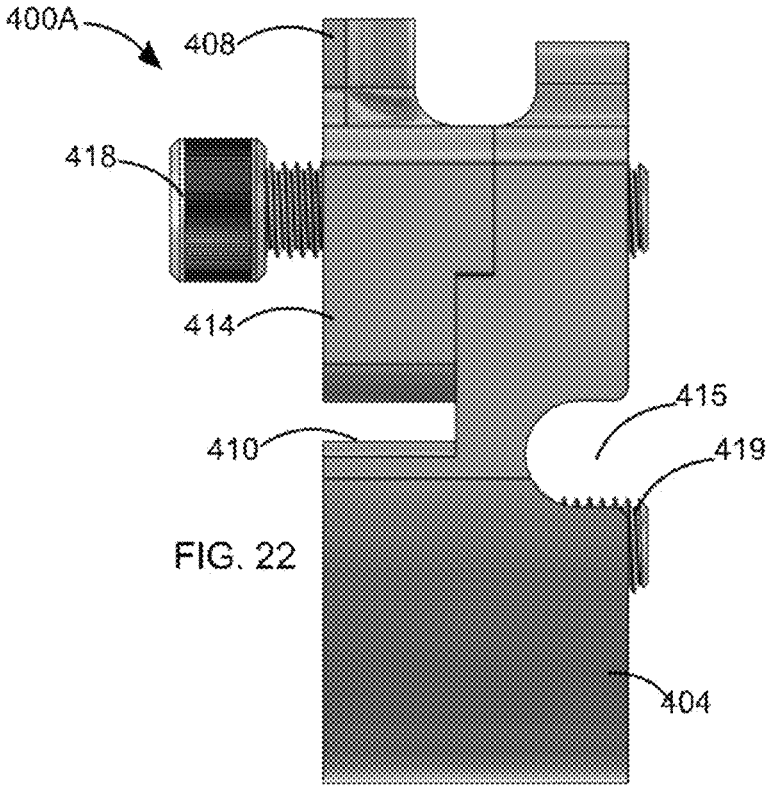
Figure 23:
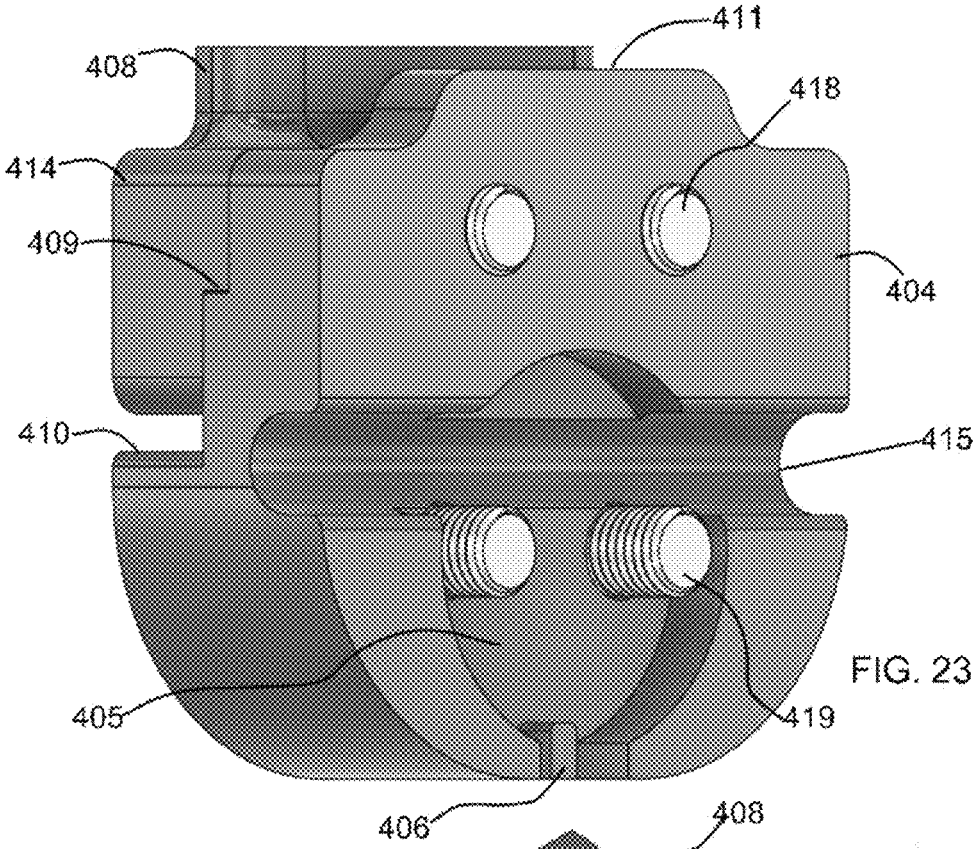
Figure 24:
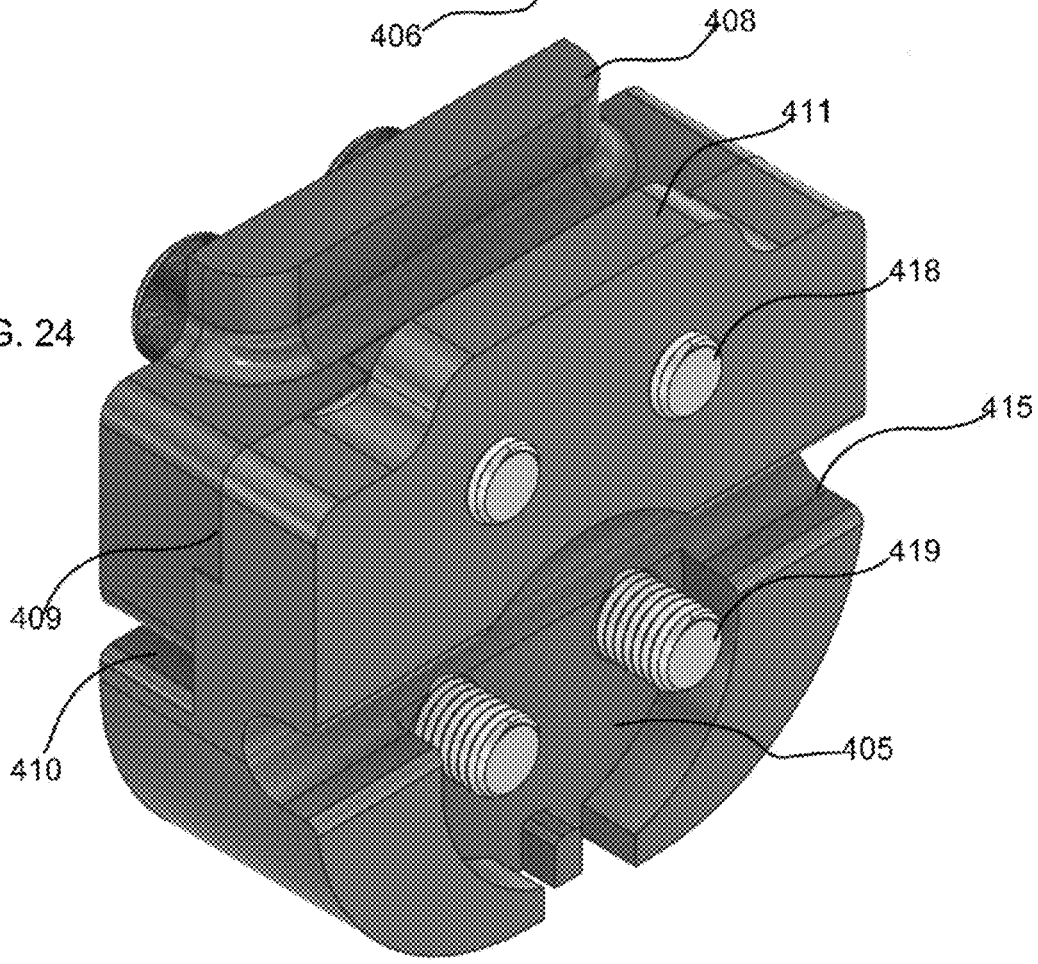
Figure 25:
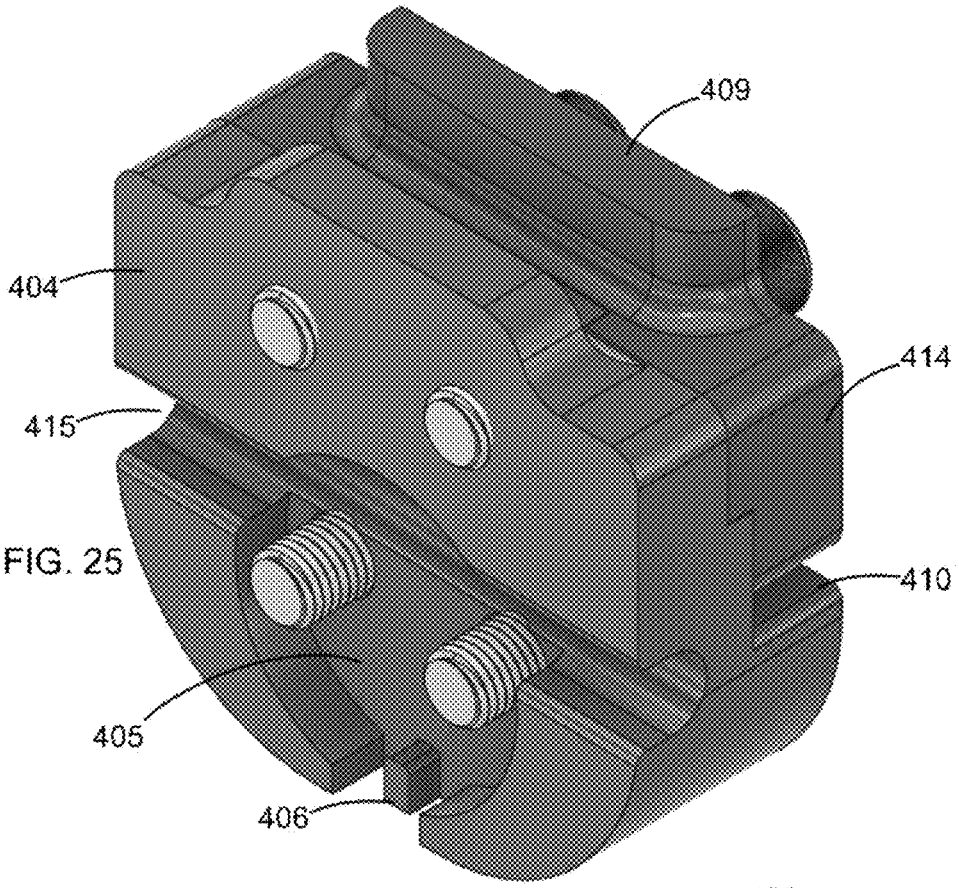
Figure 26:
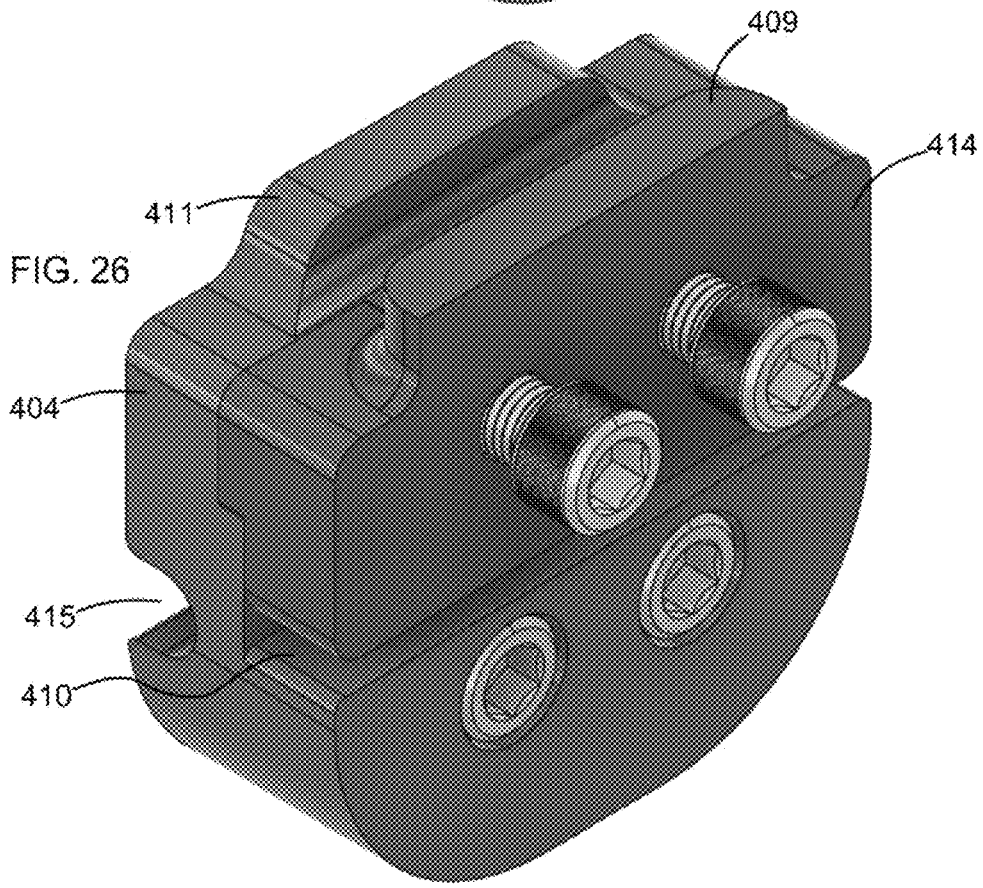
Figure 27:
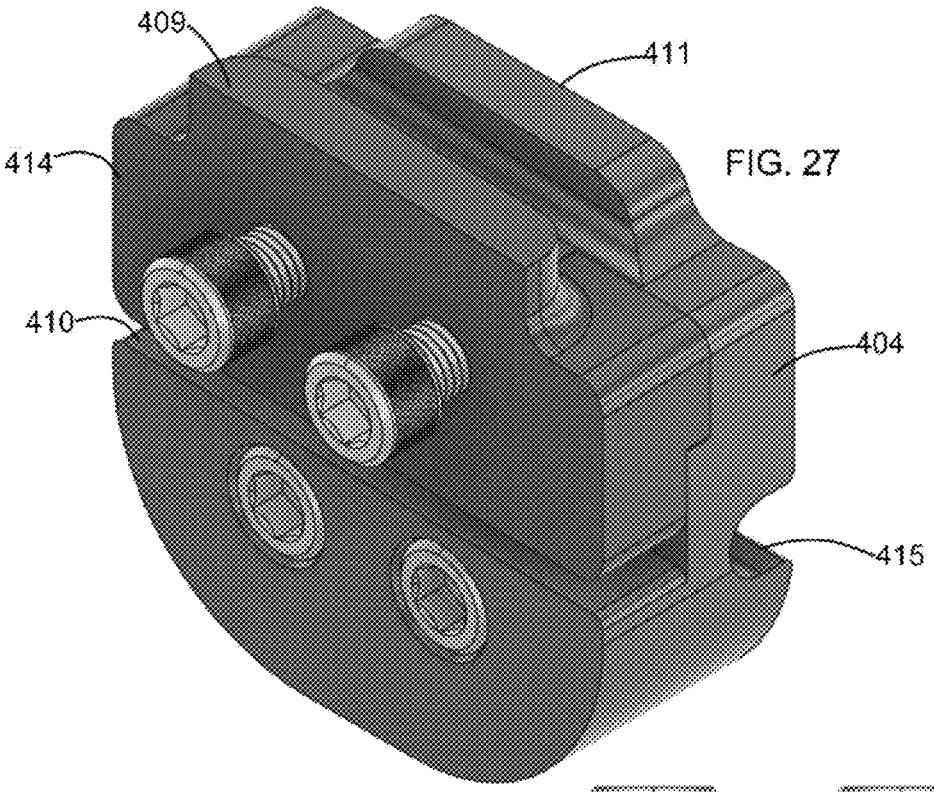
Figure 28:
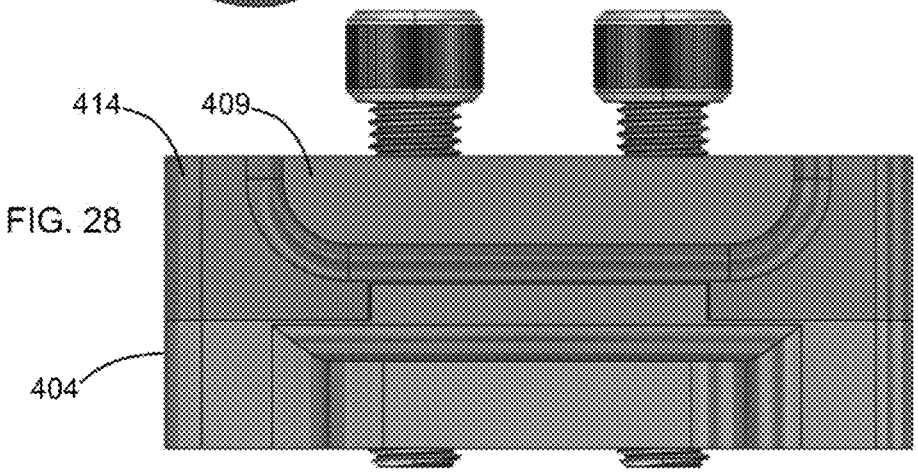
Figure 29:
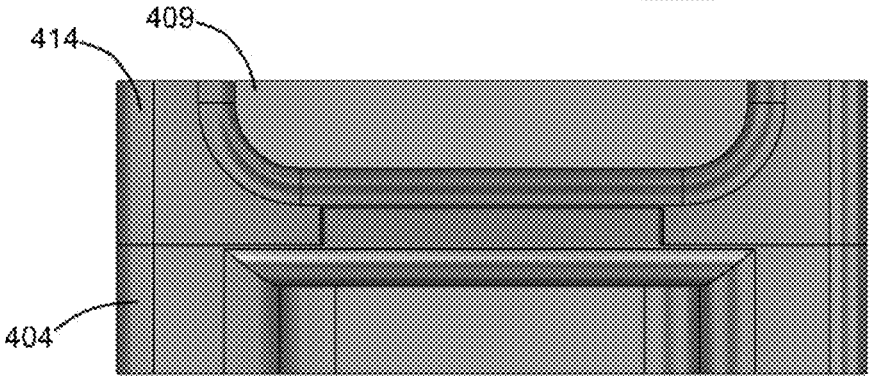
Figure 30:
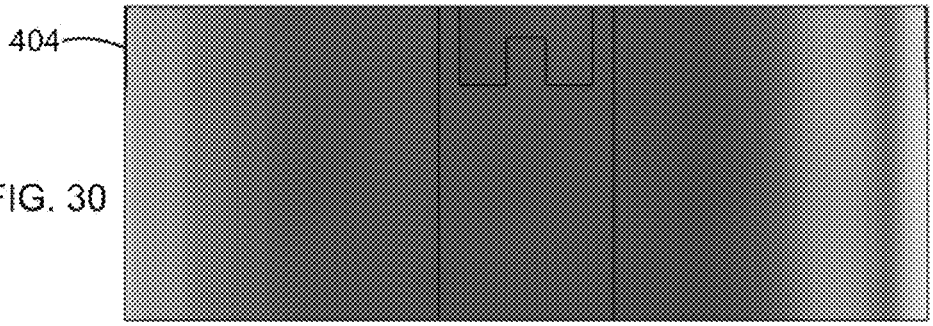
Figure 31:
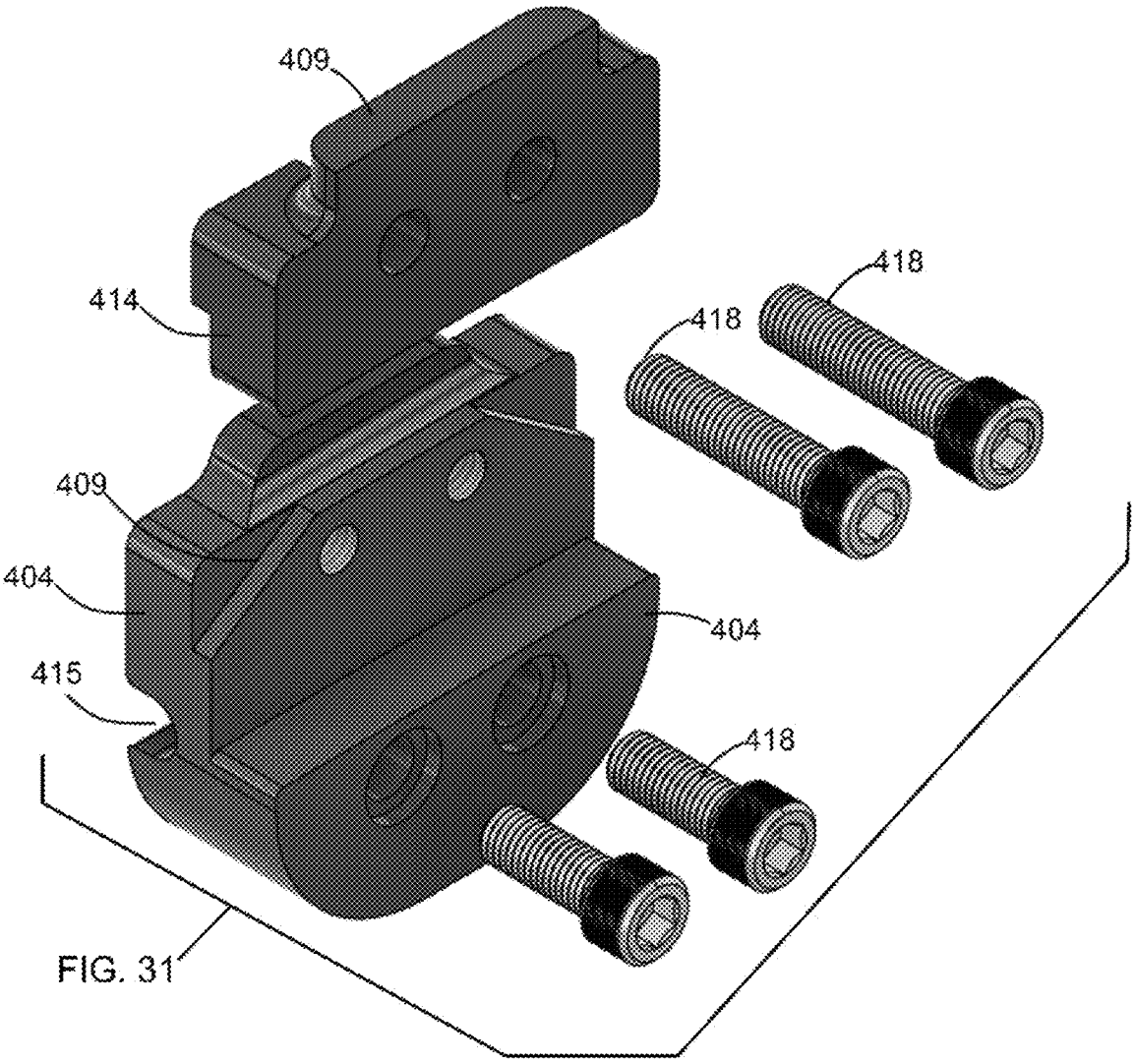
Figure 32:
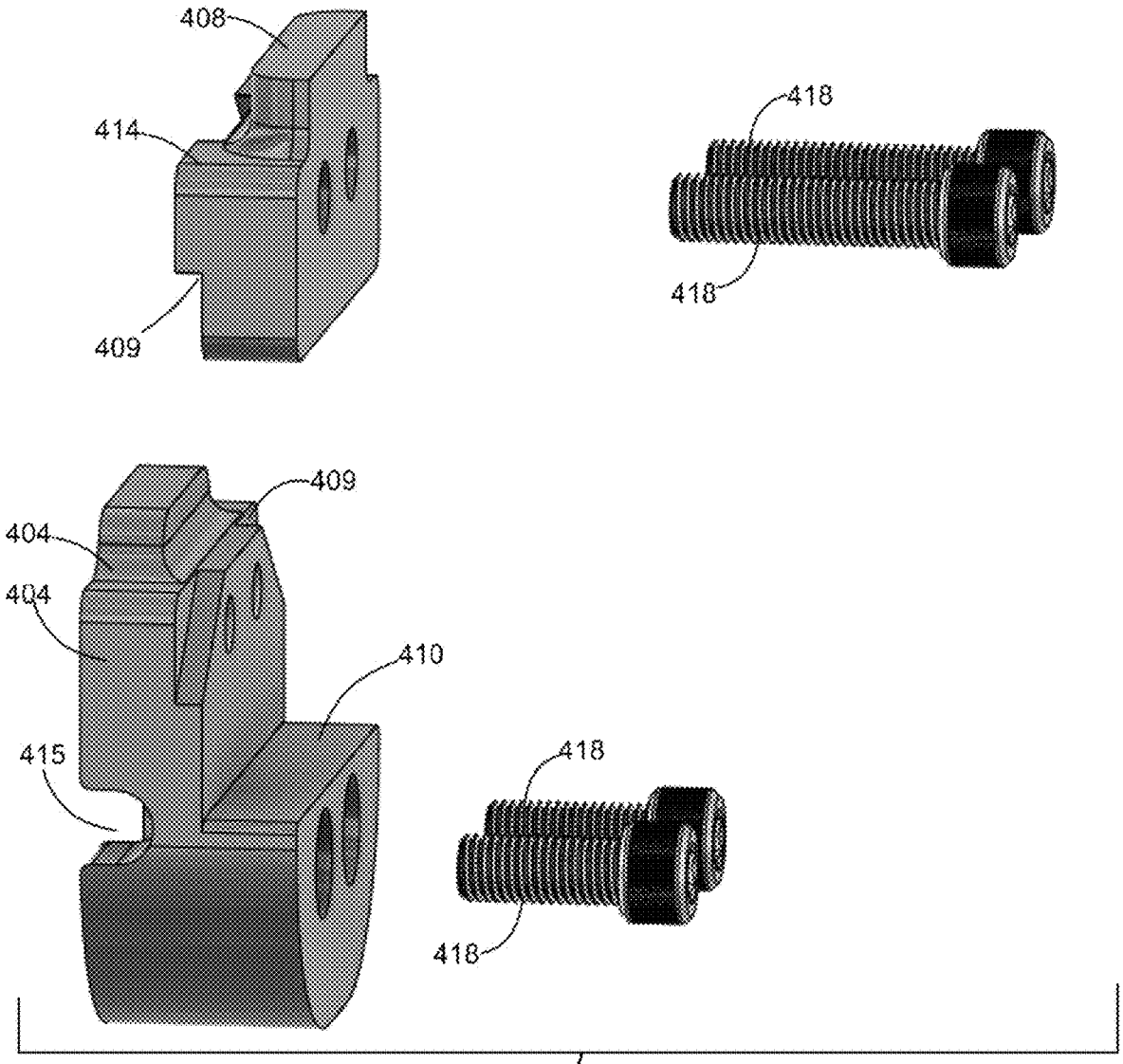
Figure 33:
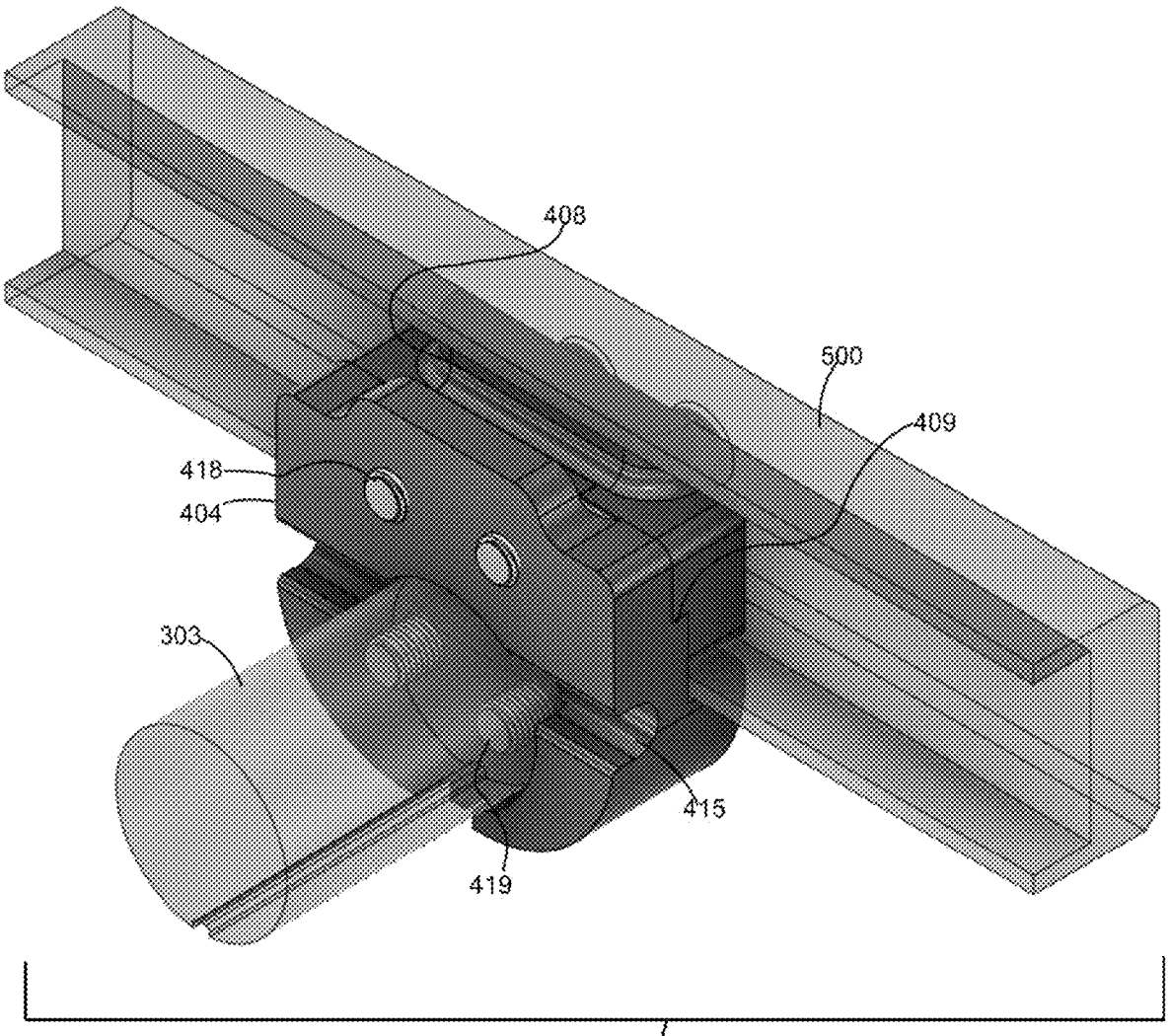
Figure 34:
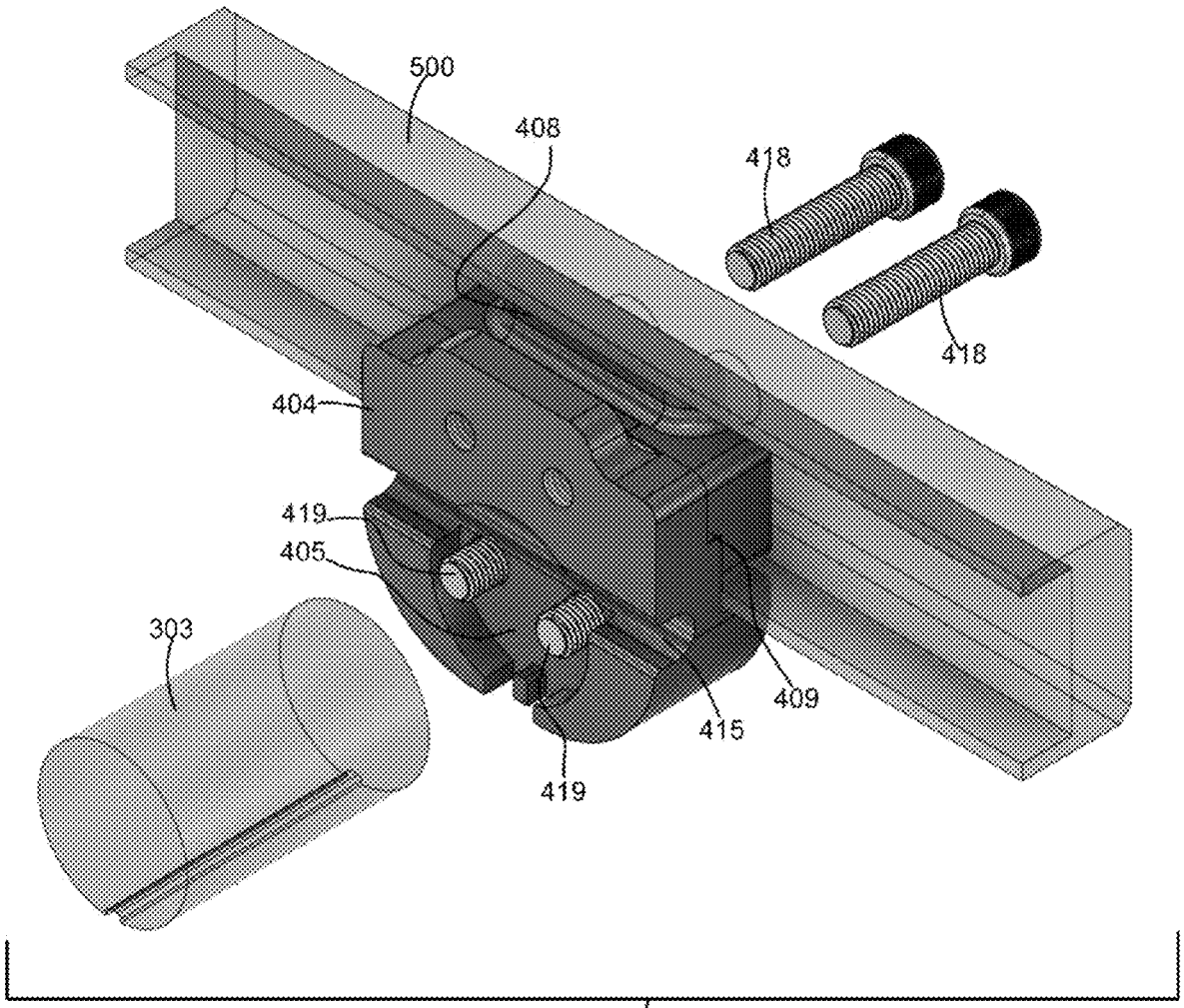
Figure 35:
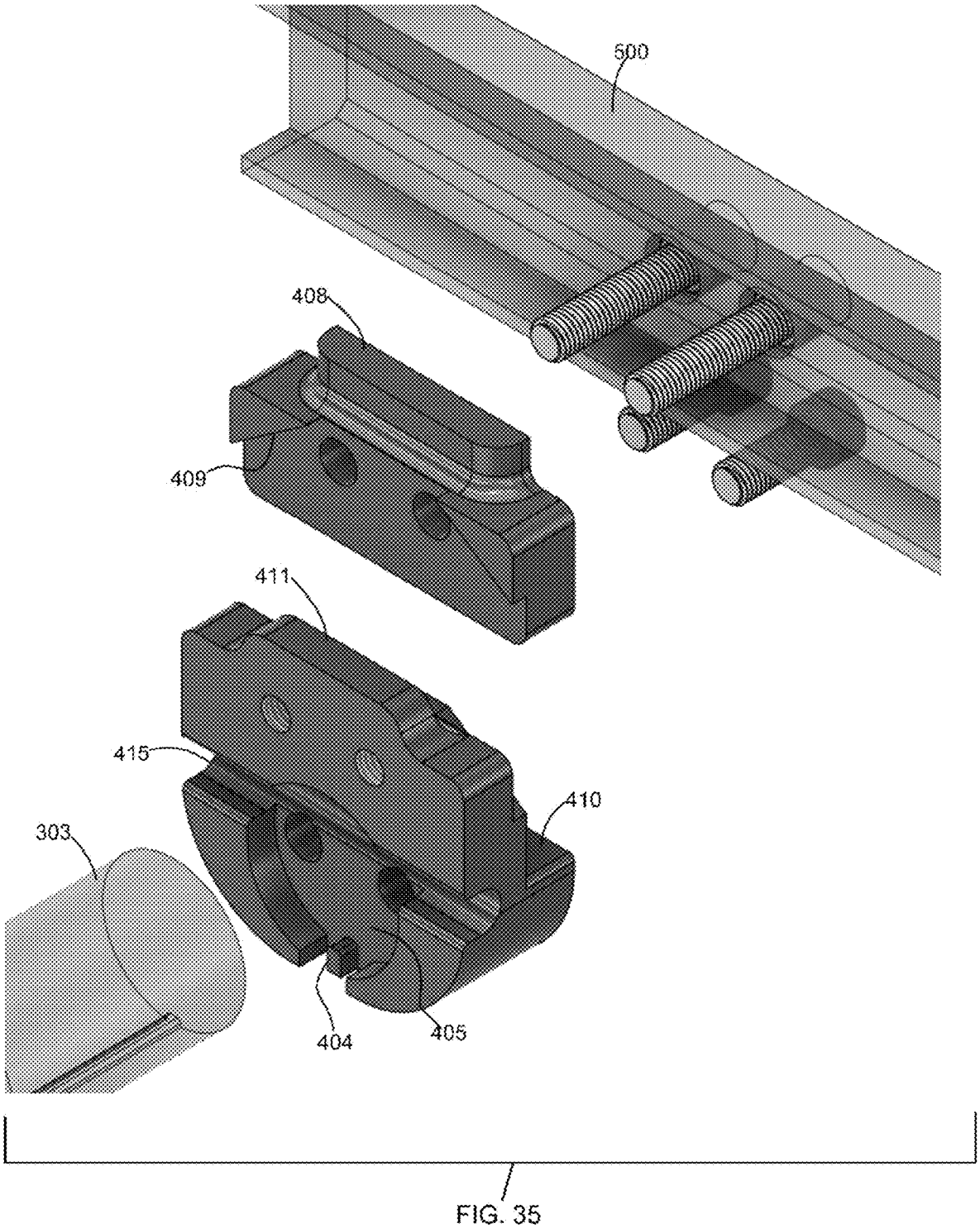
Figure 36:
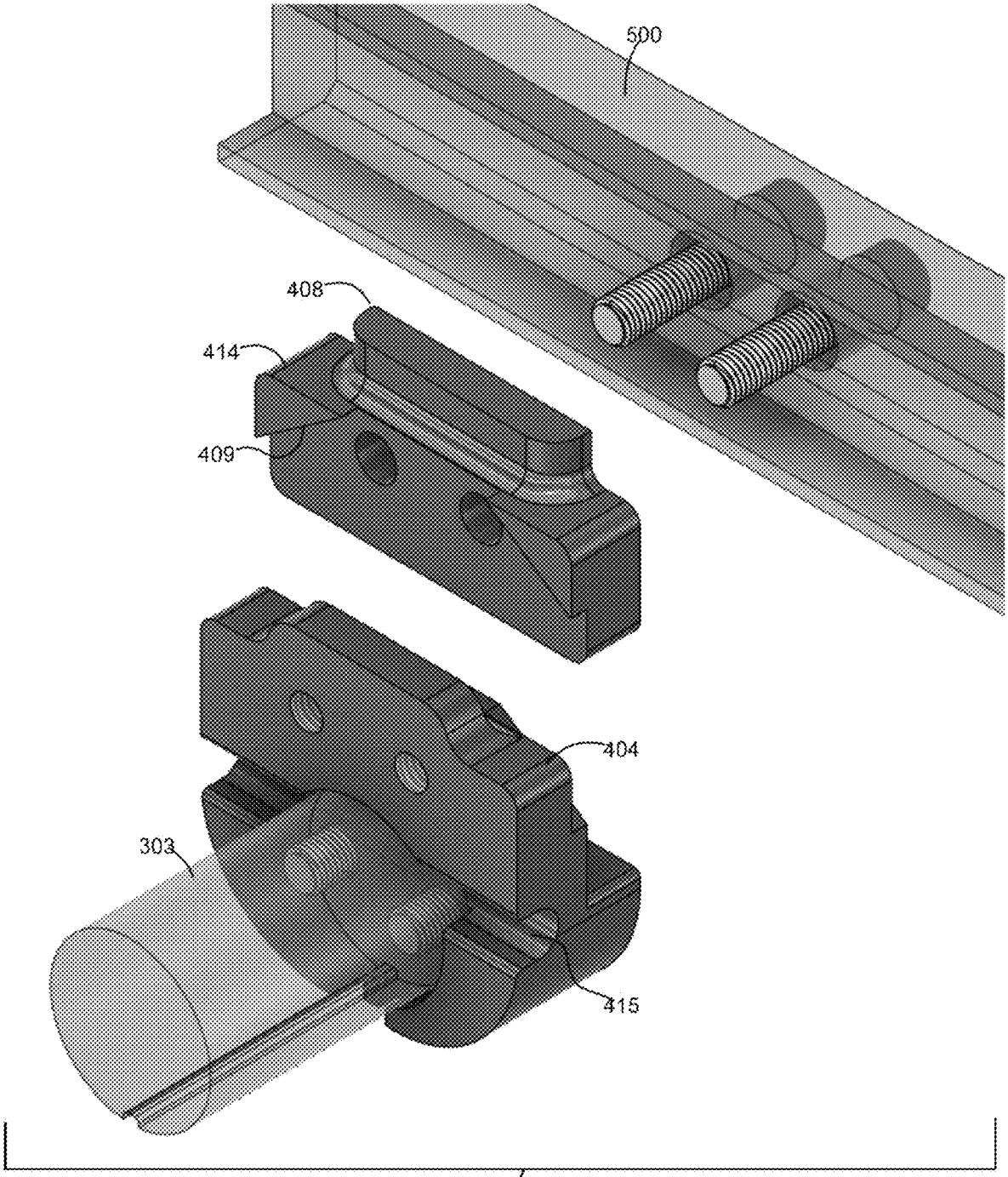
Figure 37:
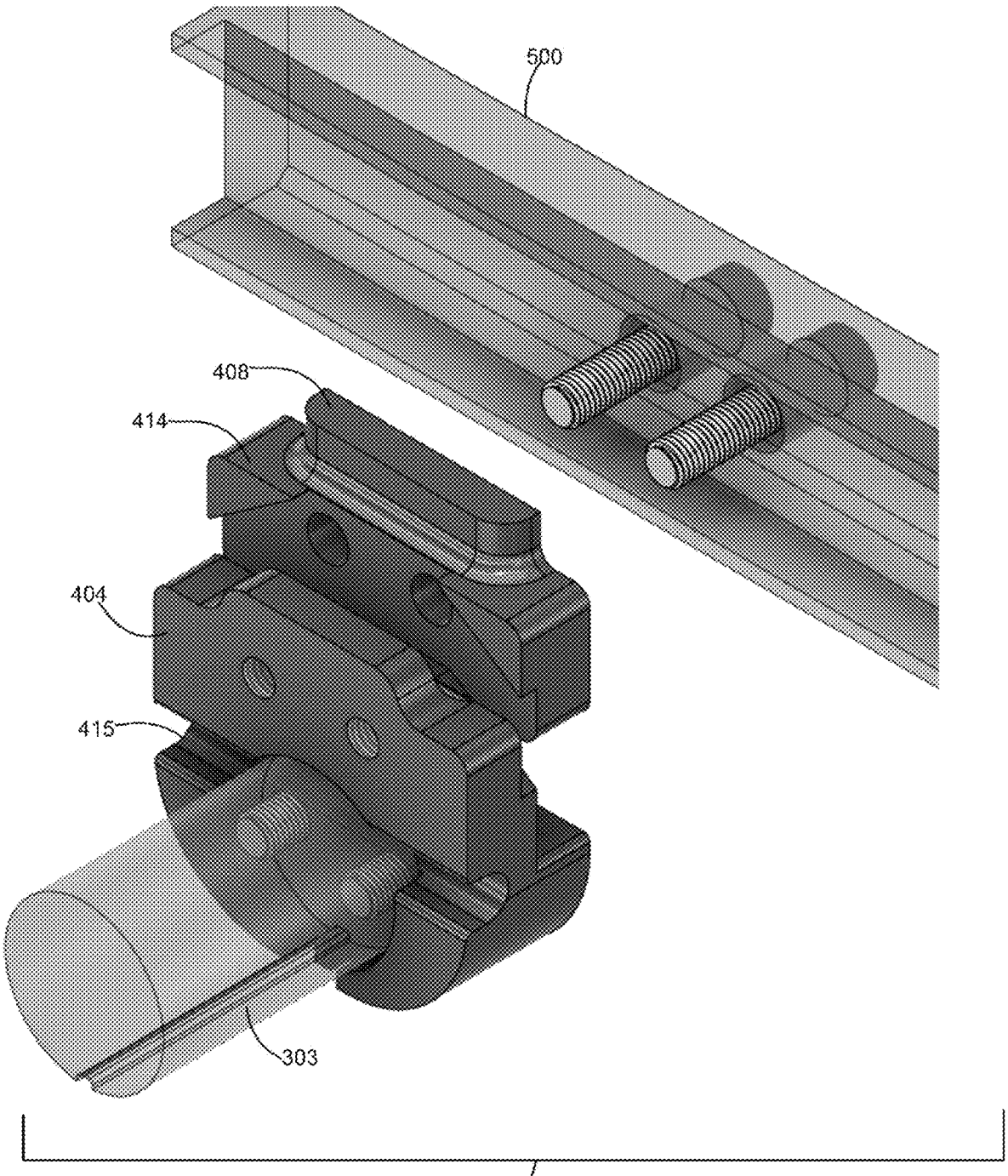
Figure 38:
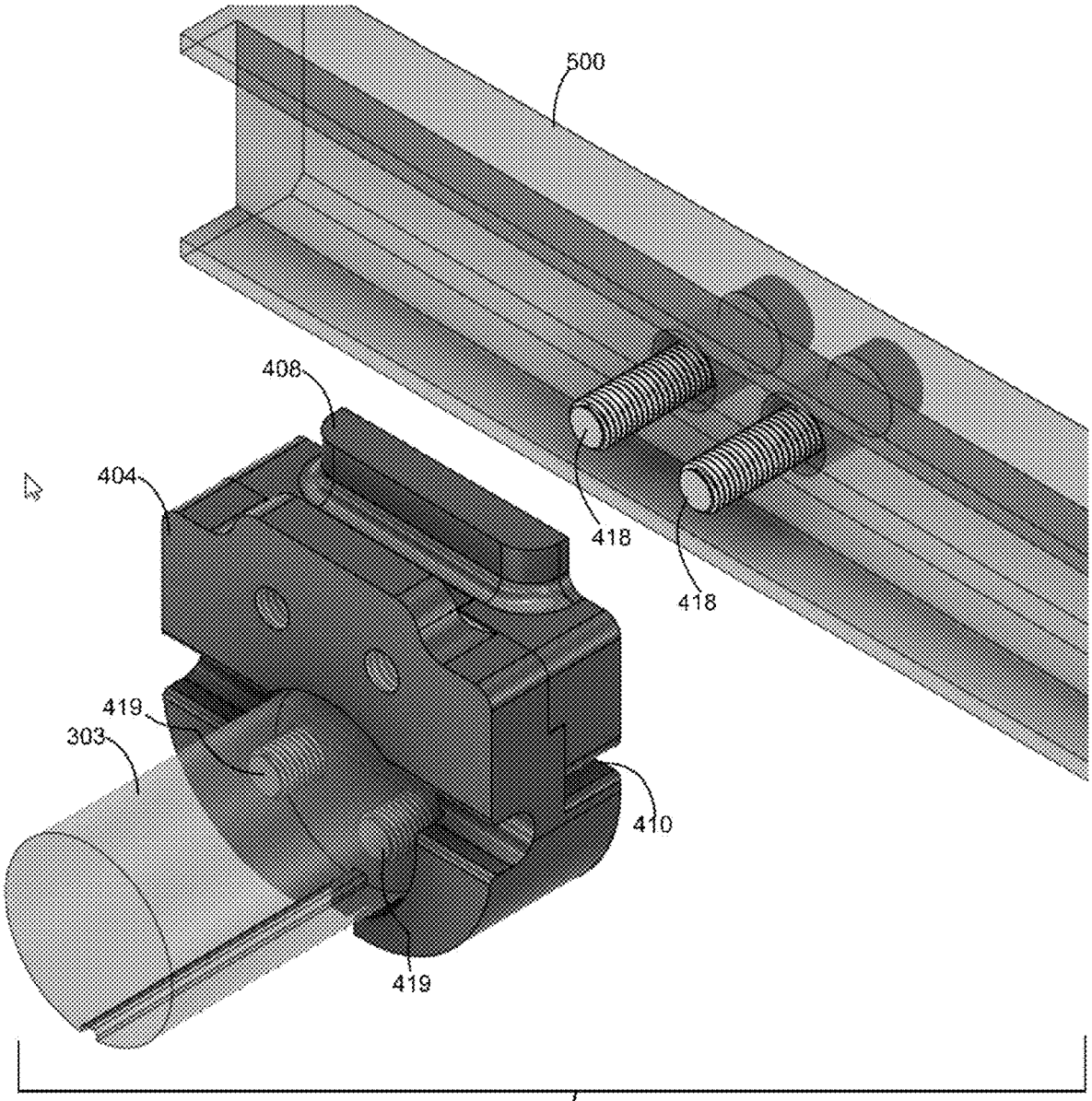
Figure 39:
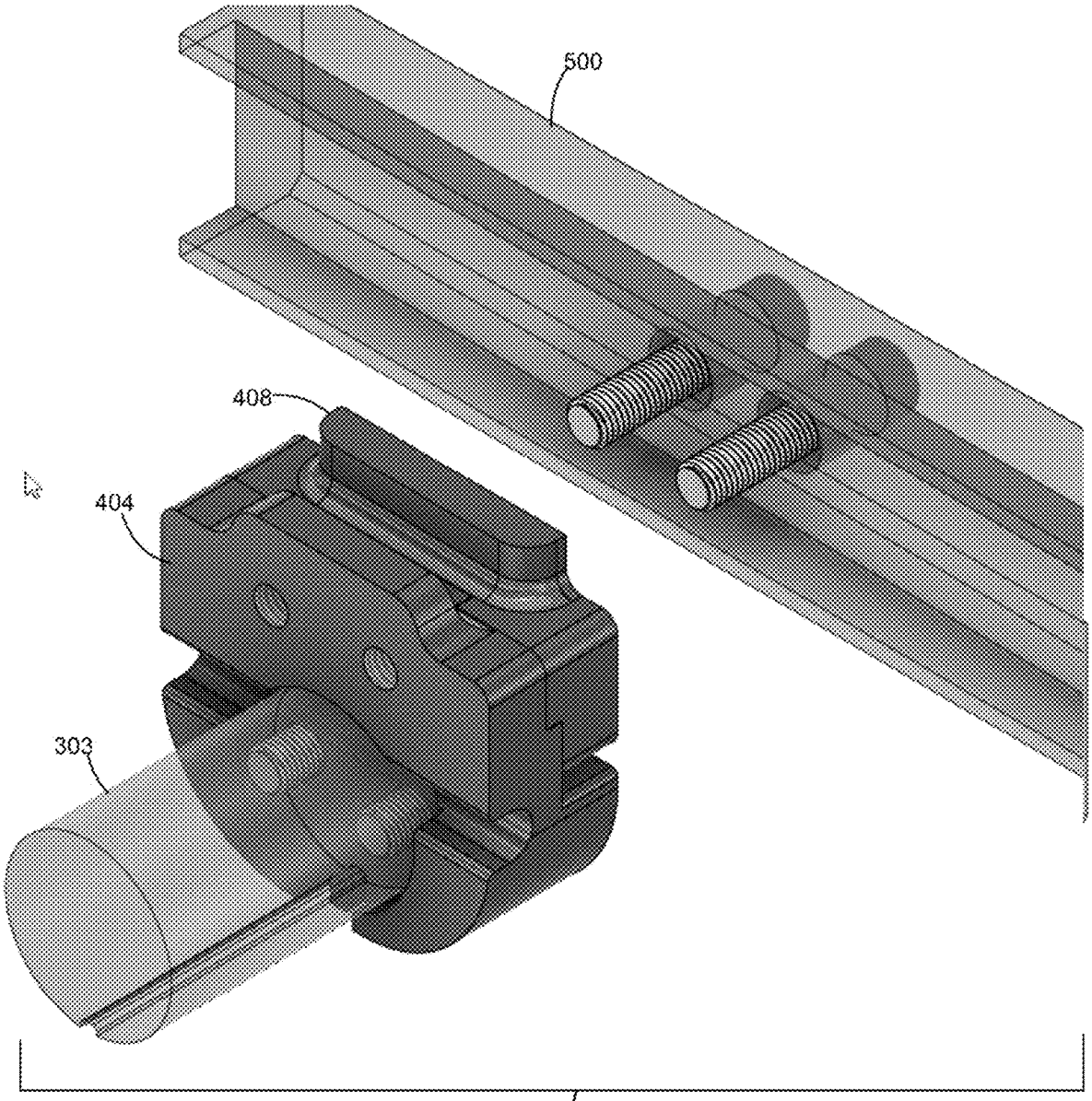
Figure 40:
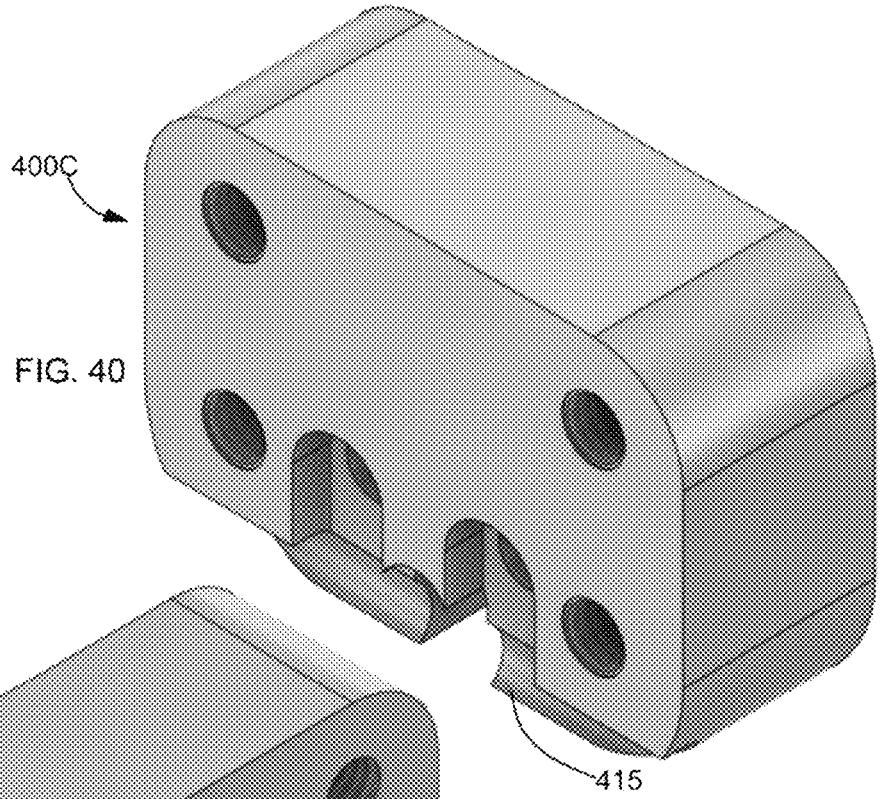
Figure 41:
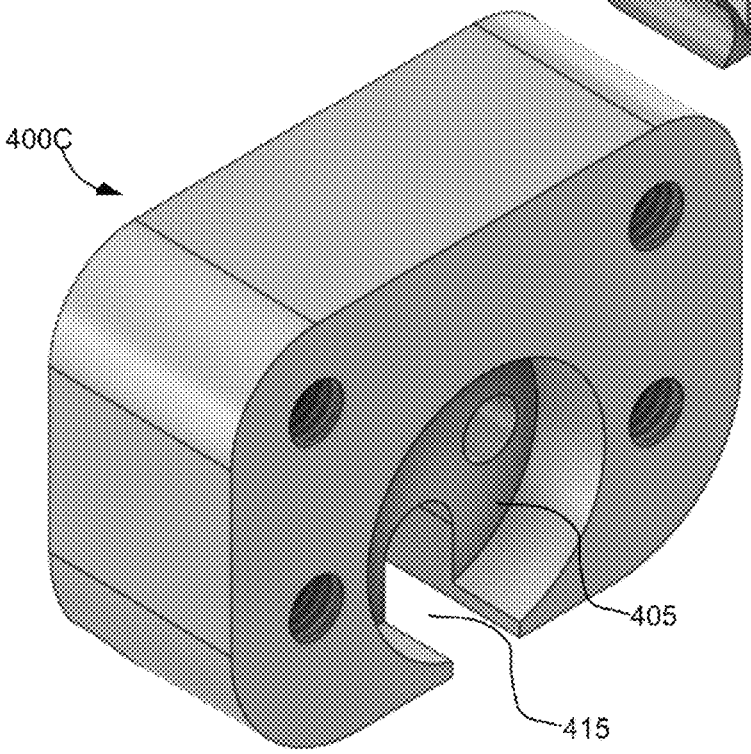
Figure 42:
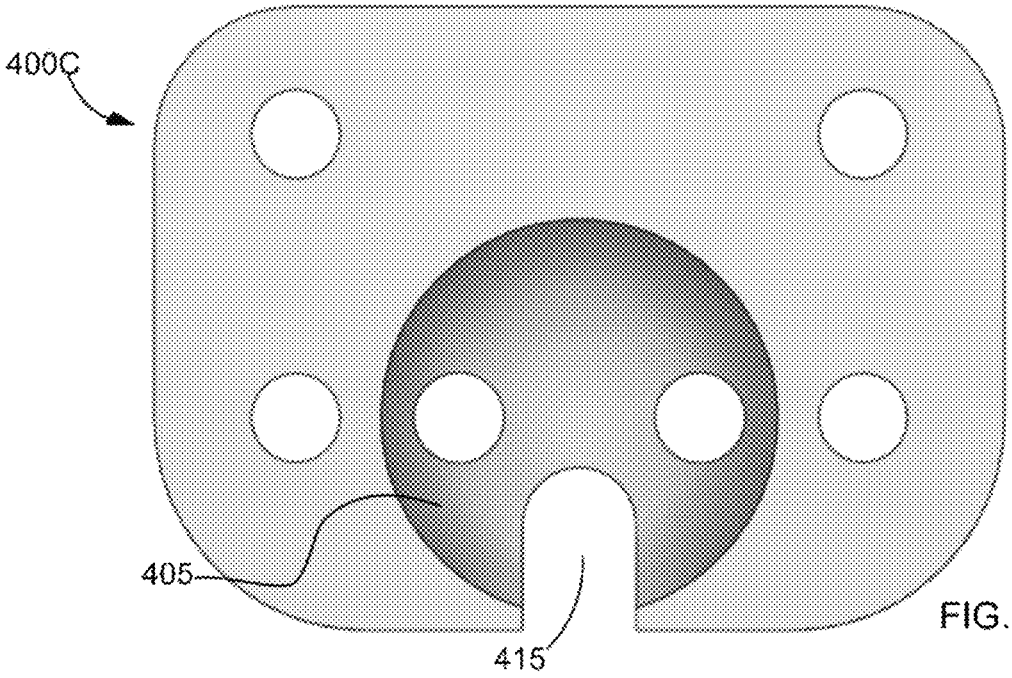
Figure 43:
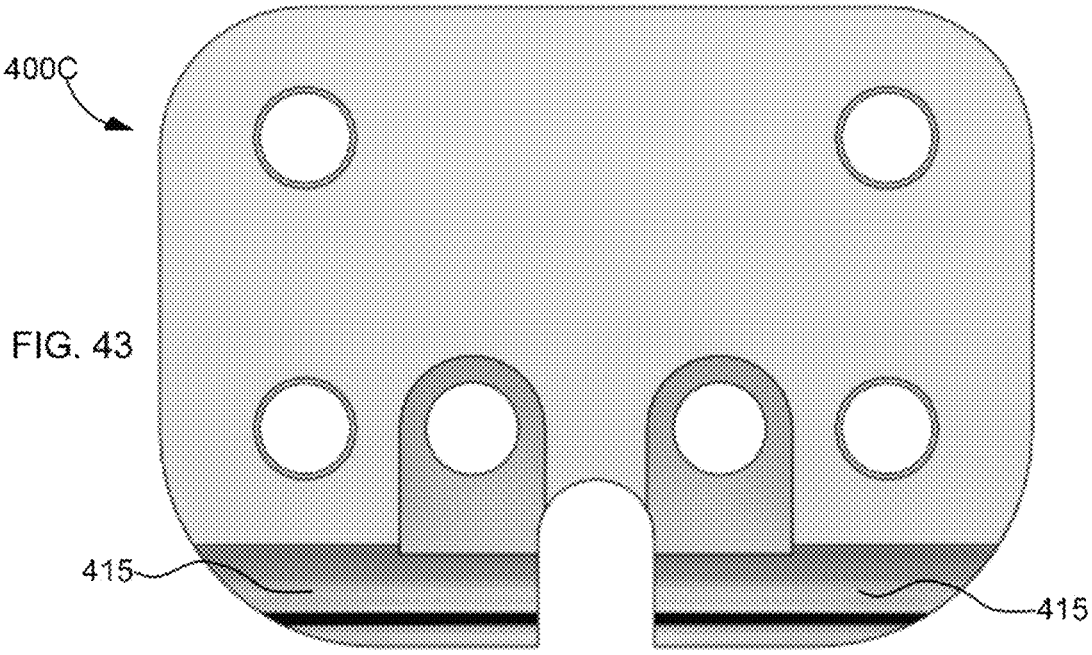
Figure 44:
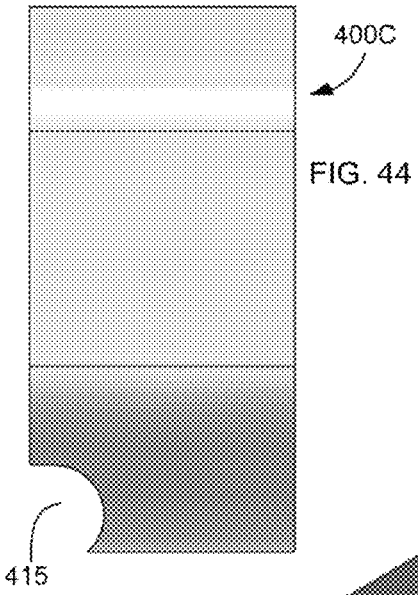
Figure 45:
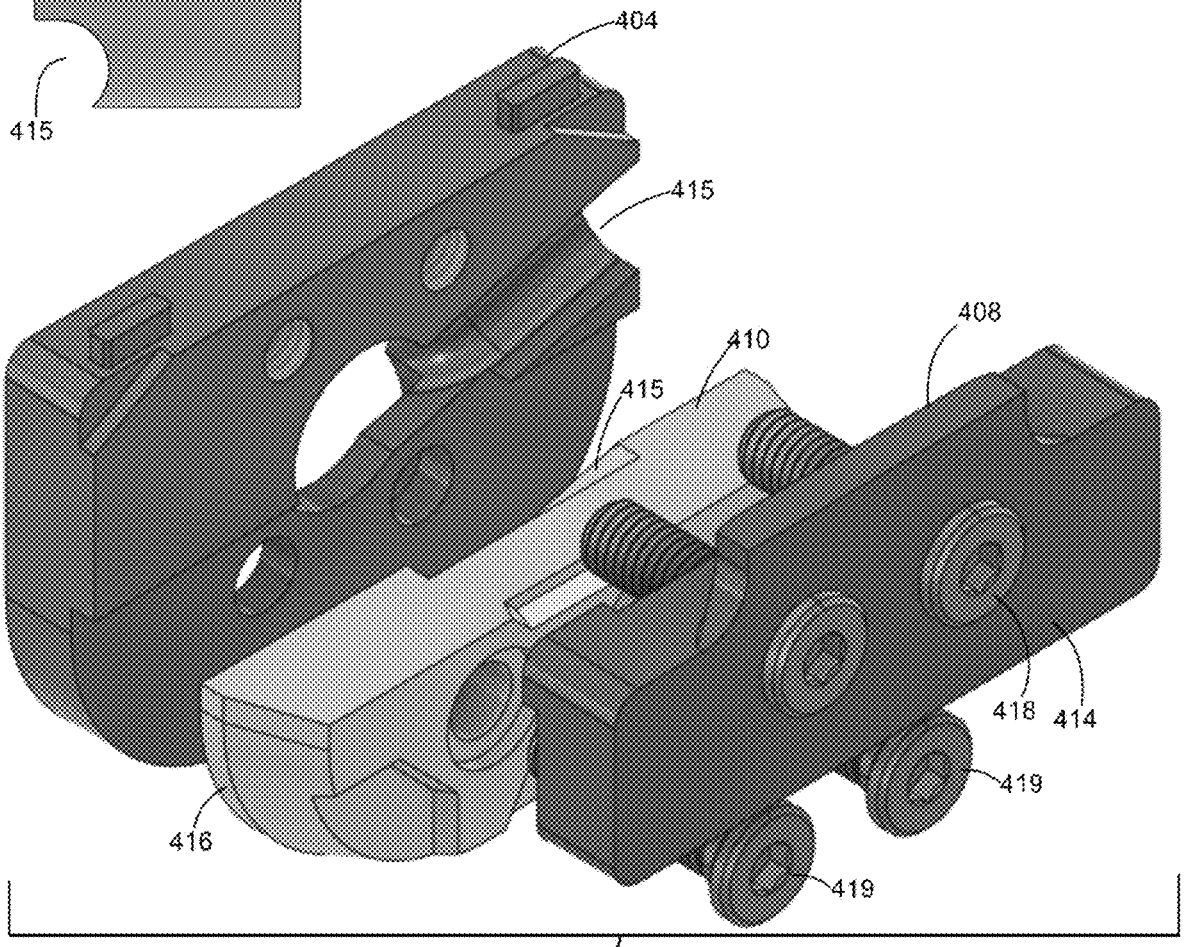
Figure 46:
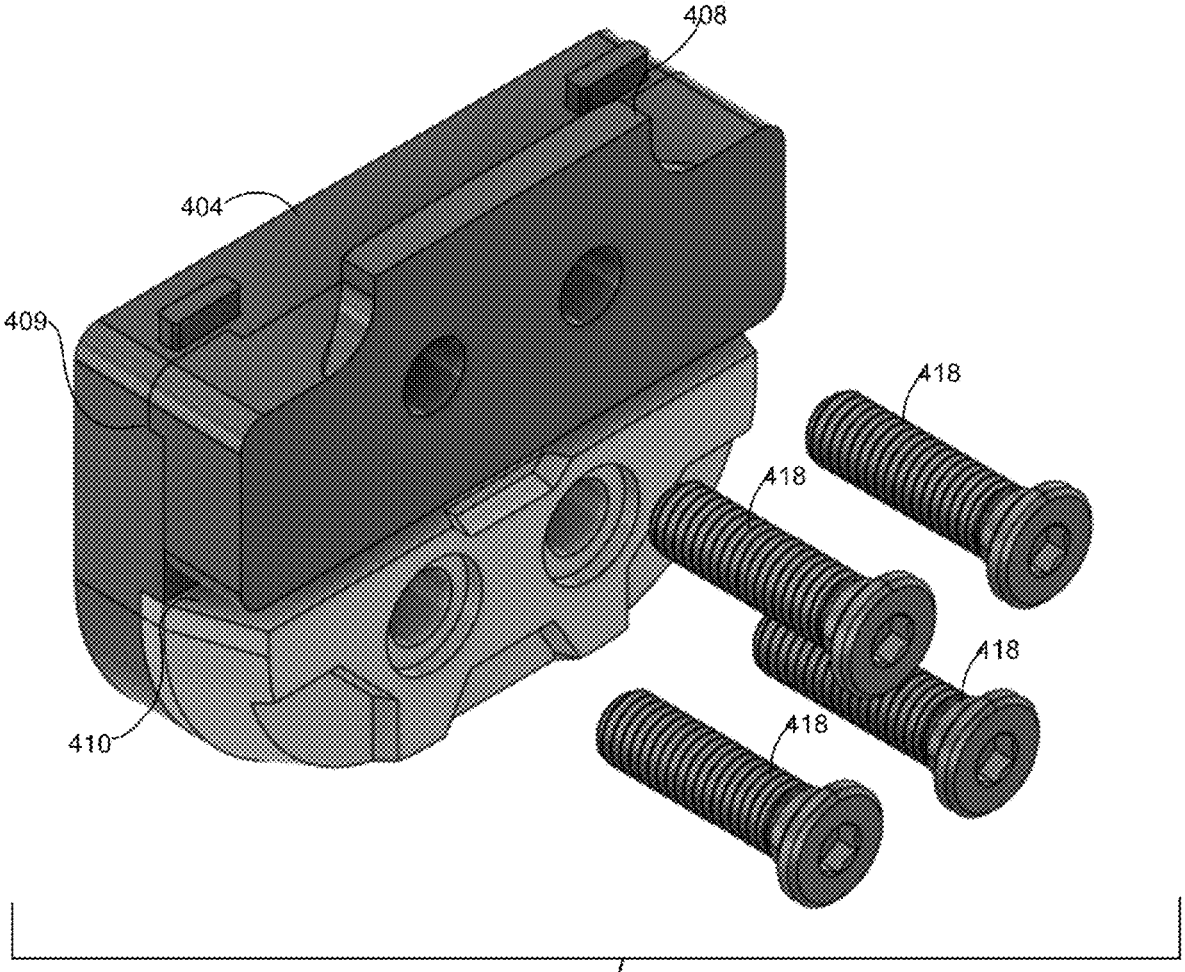
Figure 47:
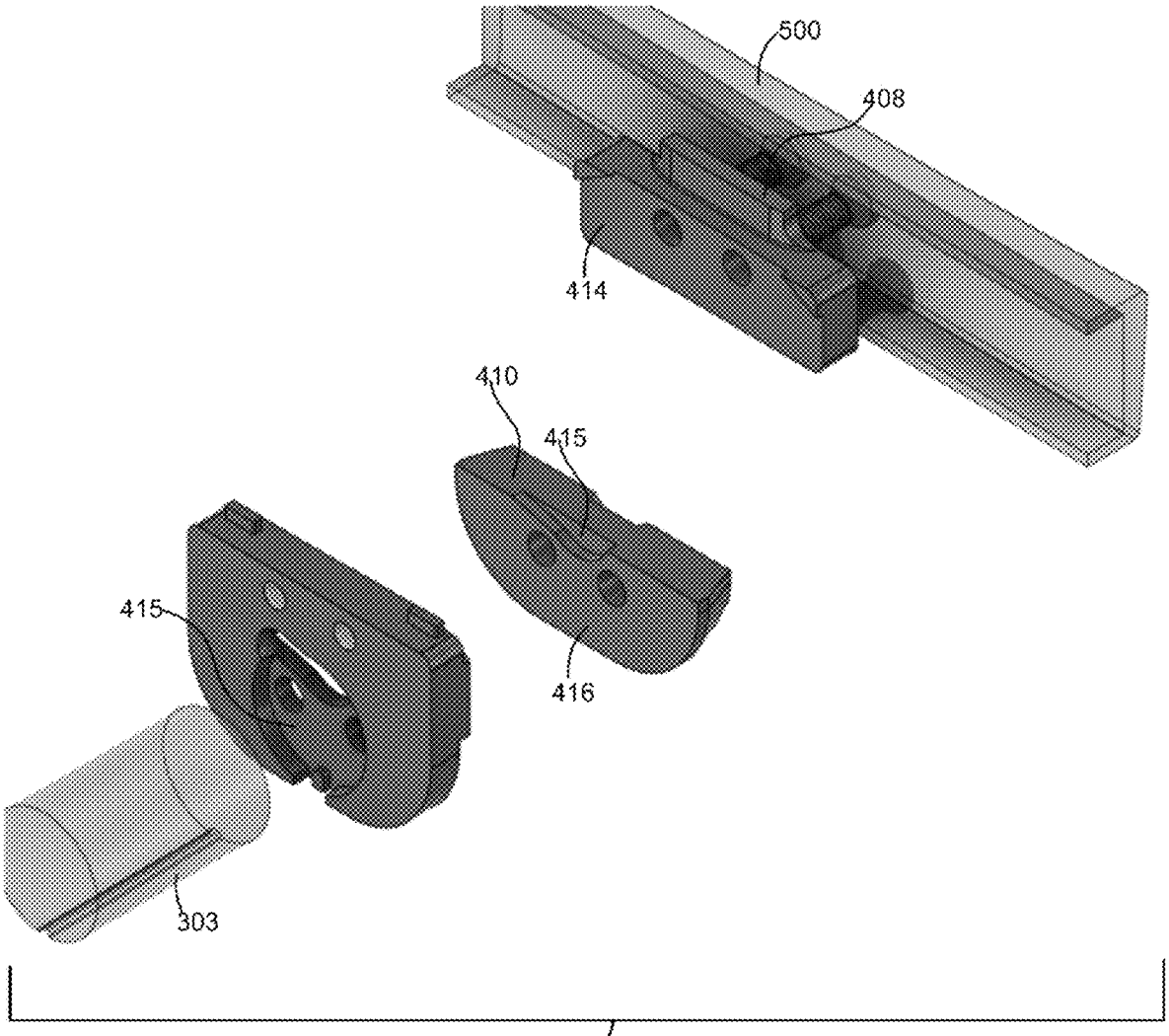
Figure 48:
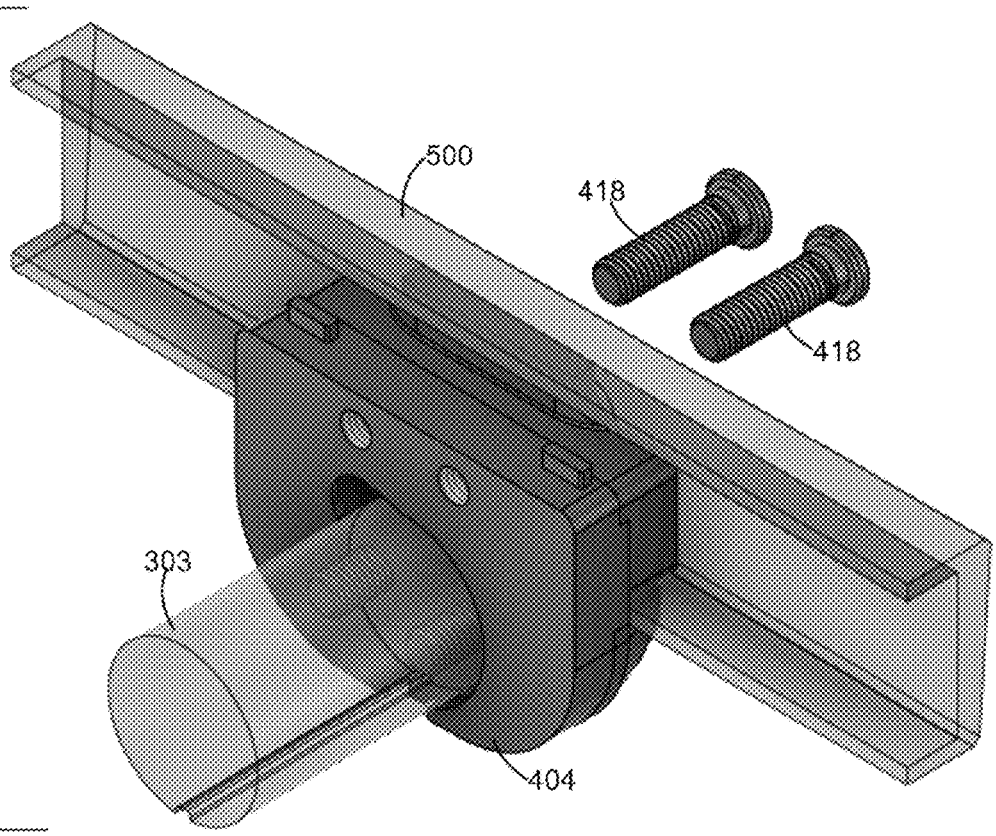
Figure 49:
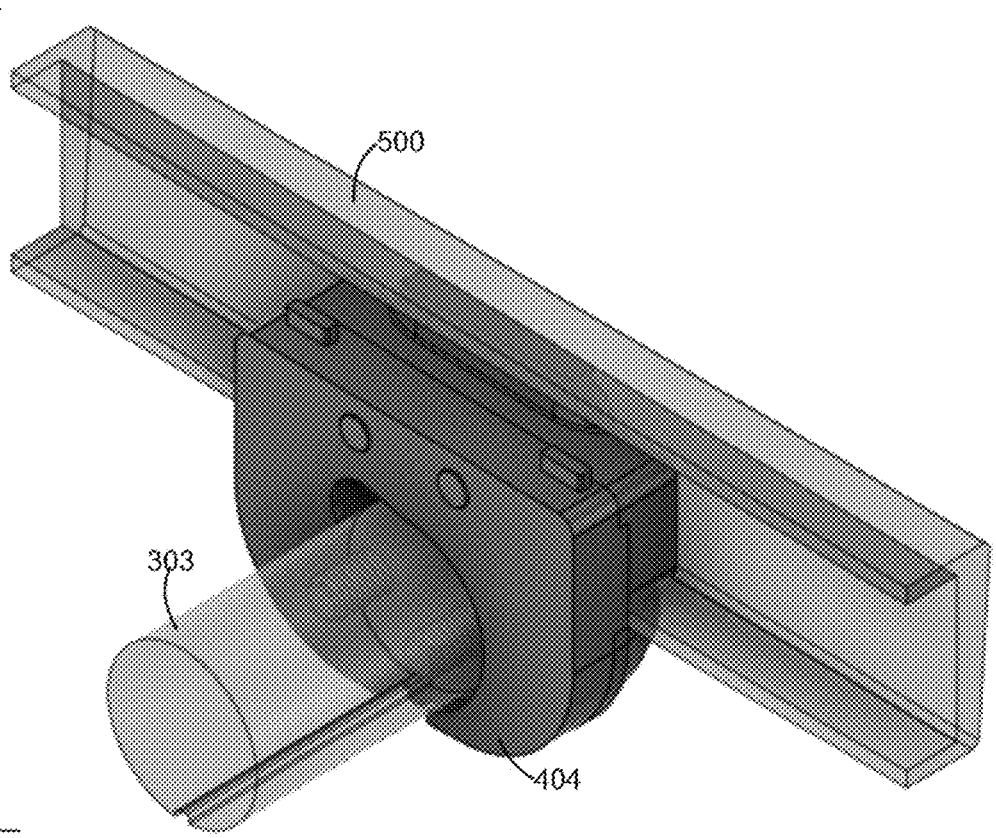
Figure 50:
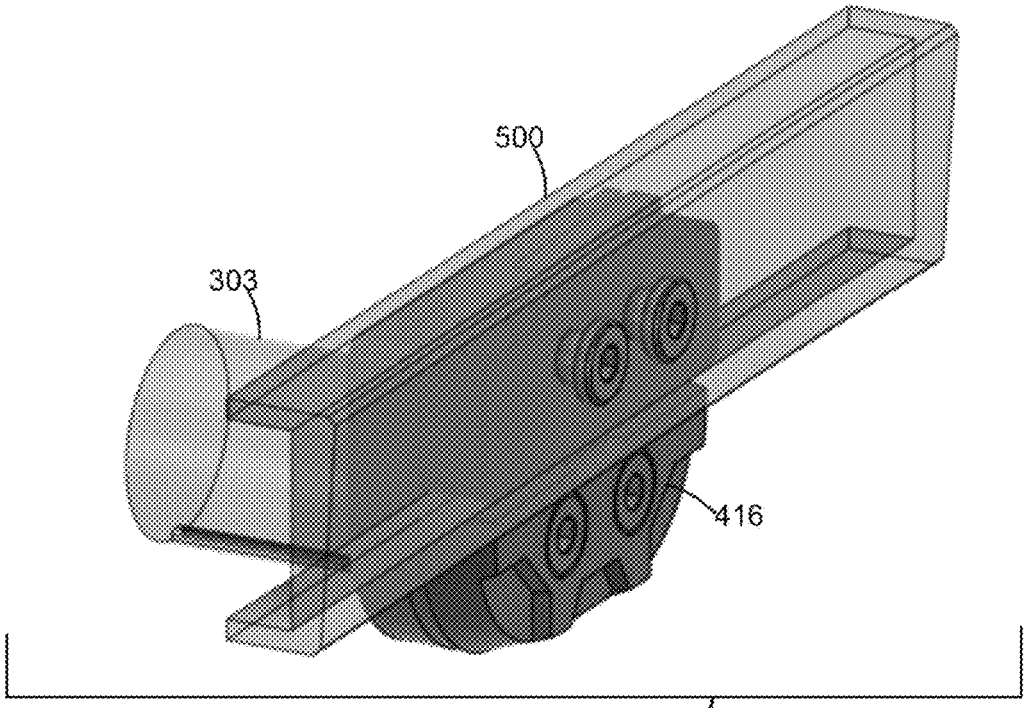
Figure 51:
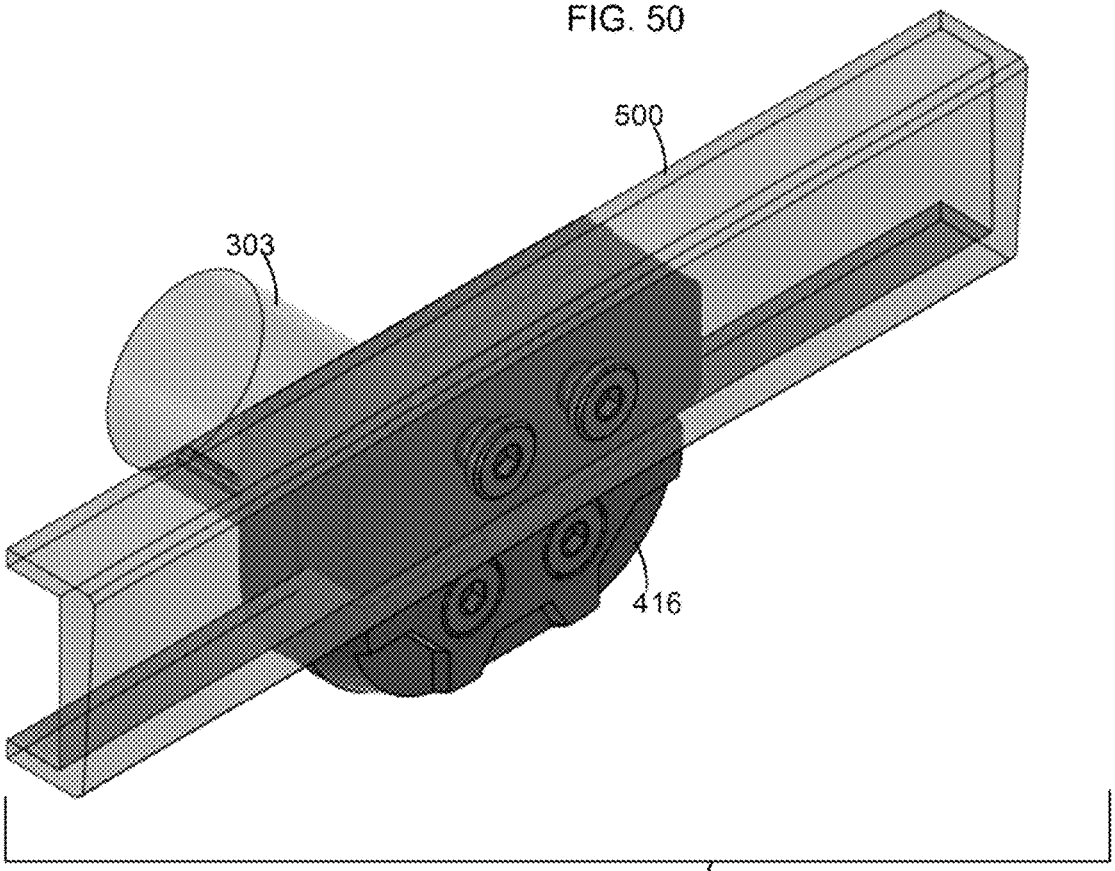
Figure 52:
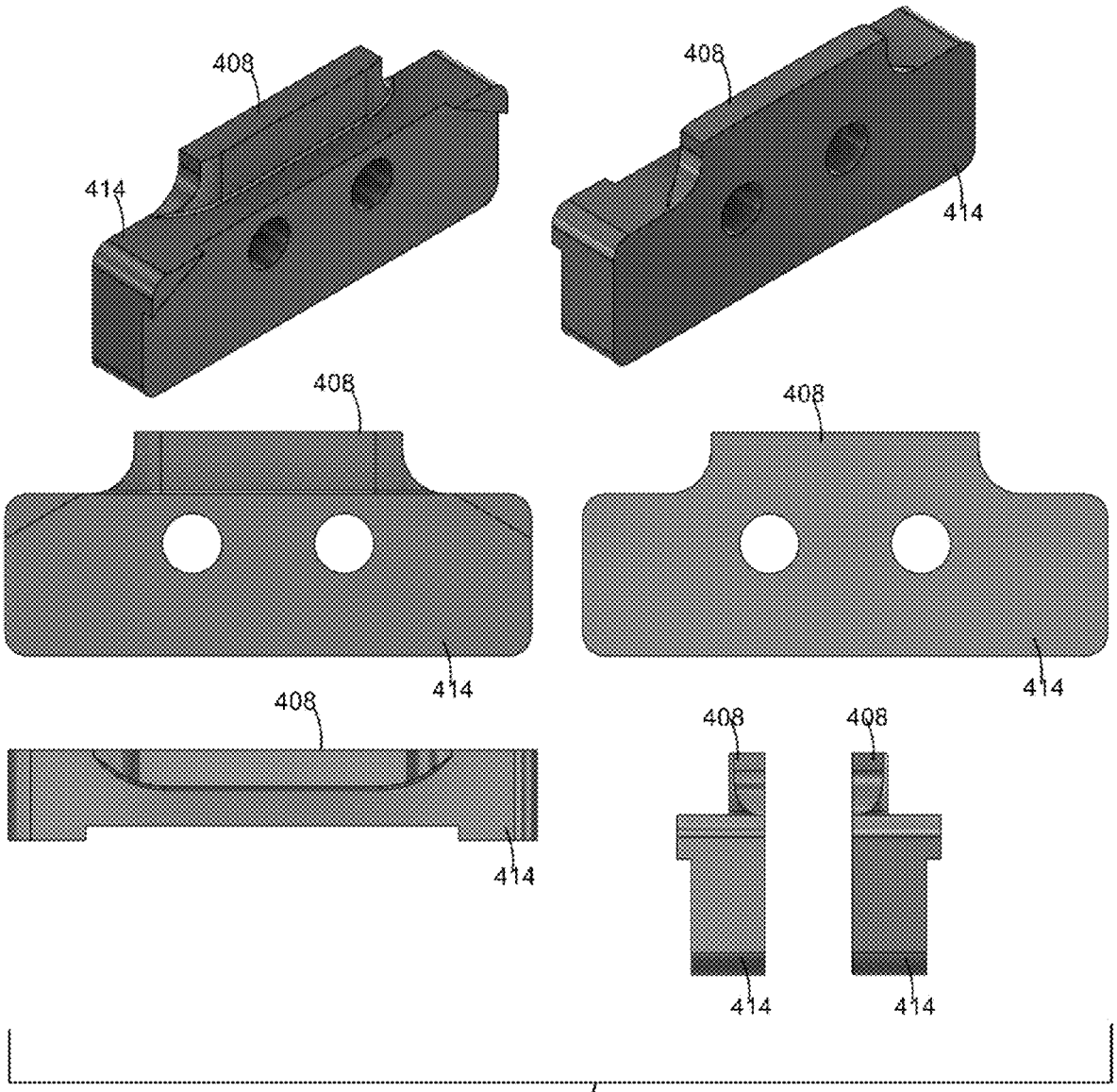
Figure 53:
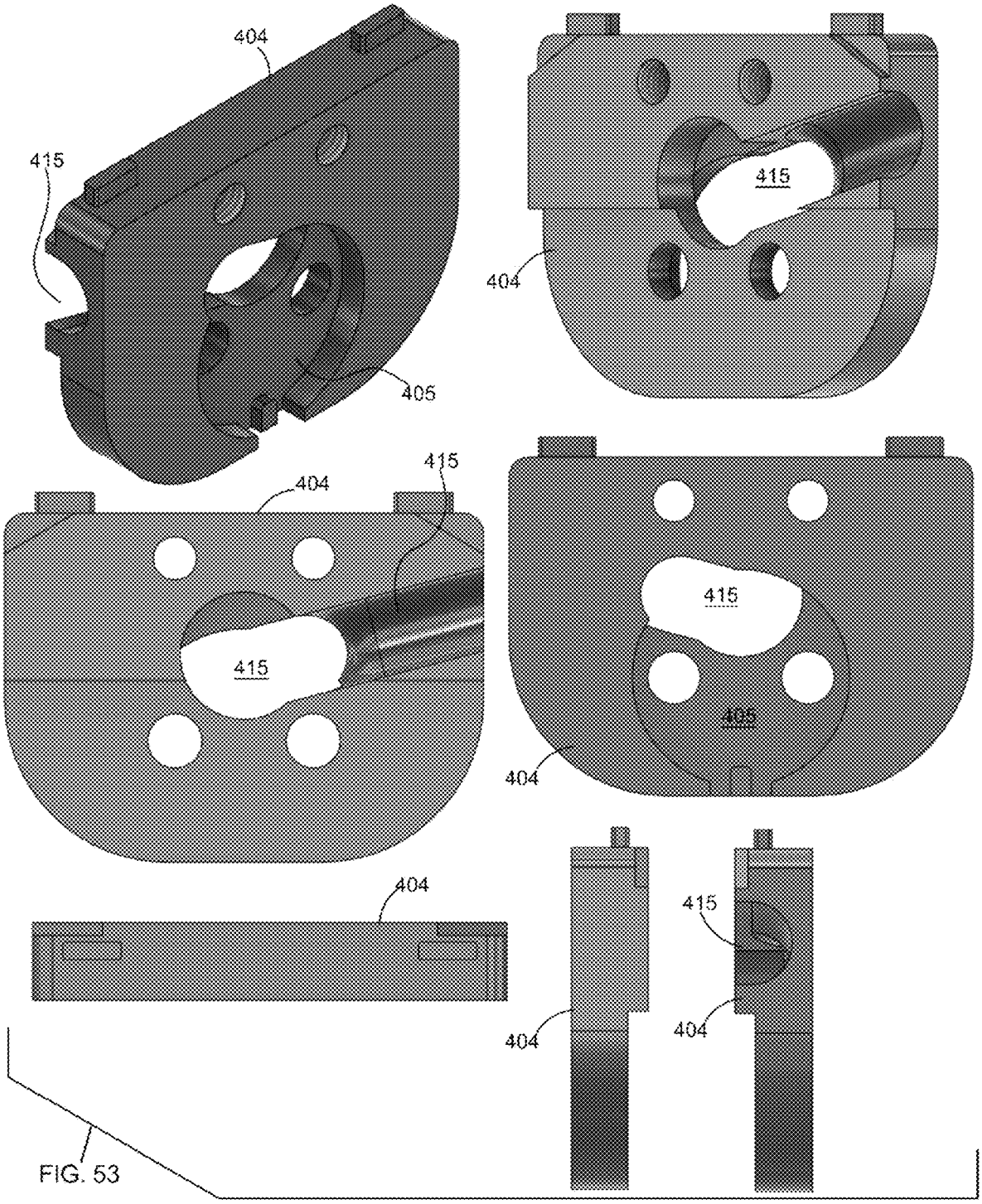
Figure 54:
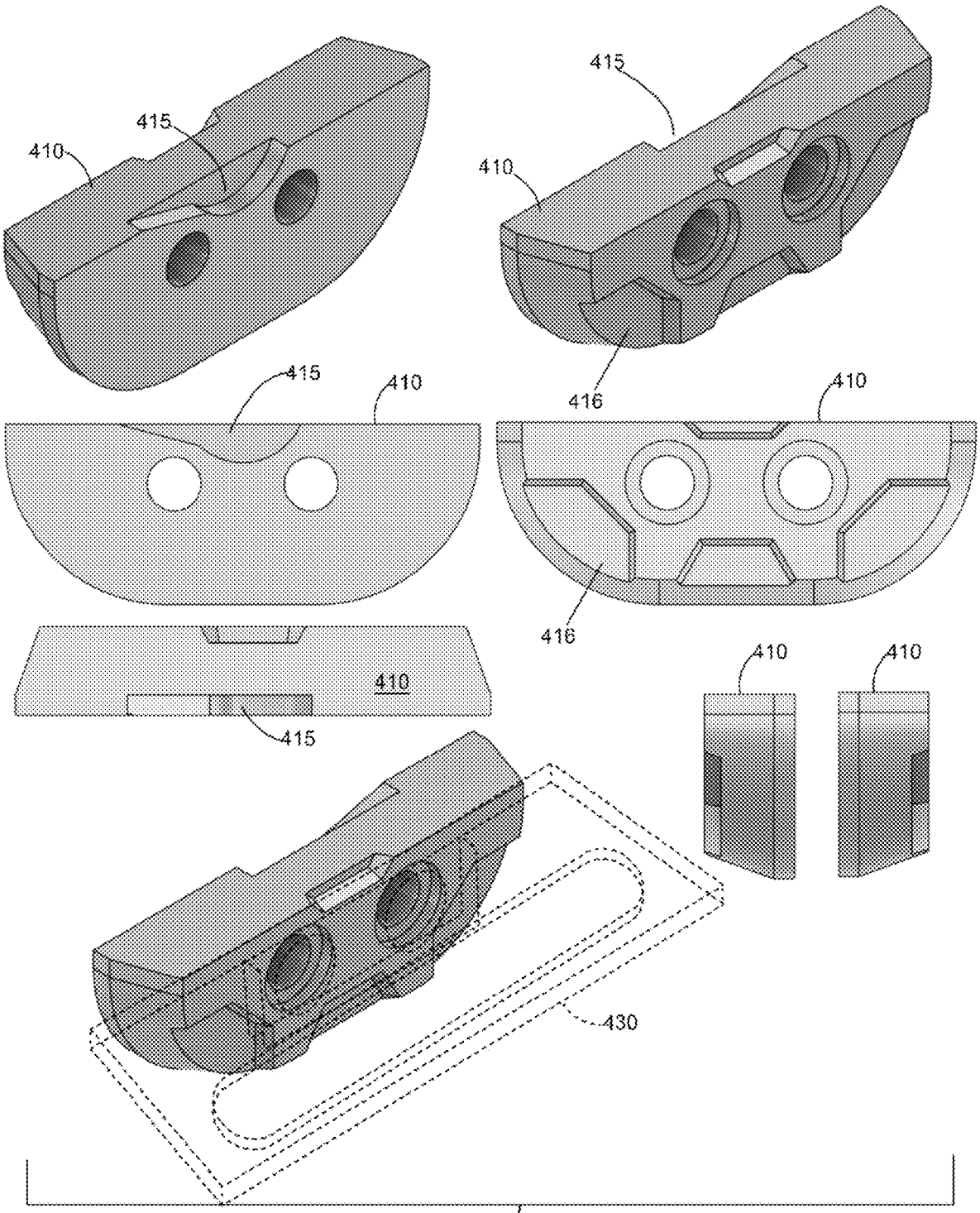

FIG. 13, in a front side perspective view shows the various elements of an example lift kit assembly;

FIG. 14, in a back side perspective view shows the various elements of an example lift kit assembly;

FIG. 15 shows another example implementation of a lift kit assembly according to the present invention;

FIG. 16 is a perspective view where (FIG. 14) has been partially rotated;

FIG. 17 is a perspective view where threaded fasteners are included in (FIG. 15);

FIG. 18 is a left side view thereof;

FIG. 19 is a perspective view where (FIG. 17) has been partially rotated;

FIG. 20 is a front view thereof;

FIG. 21 is a perspective view where (FIG. 20) has been partially rotated;

FIG. 22 is a right side view thereof;

FIG. 23 is a right side and back perspective view thereof;

FIG. 24 is a top and back perspective view thereof;

FIGS. 25, 26 and 27 are other perspective views thereof;

FIG. 28 is a top view thereof with fasteners;

FIG. 29 is a top view thereof without fasteners;

FIG. 30 is a bottom view thereof;

FIG. 31 is an exploded view thereof;

FIG. 32 is another exploded view thereof;

FIG. 33 is a partial view showing a relevant section of a rail frame (500) typical of some motorized skateboards, and a lift kit assembly (400A) interlocked with the rail frame via upper lip engagement portion (408) which resides in channel (500);

FIG. 34 is a partial exploded view thereof;

FIG. 35 is another partial exploded view thereof showing the axle seat (405) of the axle cup member (404);

FIG. 36 is another partial exploded view thereof showing axle (303) secured in the in axle seat (405);

FIGS. 37, 38 and 39 are partial exploded views thereof showing an interlocking arrangement of elements (404, 408) of an example lift kit assembly (400A);

FIGS. 40, 41, 42, 43 and 44 show a one-piece lift kit block (400C) with axle seat (405) and power cord channel (415);

FIG. 45 is an exploded view another example implementation of a lift kit assembly (400B) that includes interlocking units including axle cup member (404), lower lip engagement portion (408), power cord channel (415) and upper lip engagement portion (408);

FIG. 46 shows the interlocking arrangement thereof;

FIG. 47 shows the assembly (FIG. 45) arranged with the motorized skateboard elements of axle (303) and frame (500);

FIGS. 48, 49, 50 and 51 are partial views showing the lift kit assembly mounted to frame (500);

FIG. 52 shows various views of the upper lip engagement portion (408) of lift kit assembly (400B);

FIG. 52 shows various views of the axle cup member (404) of lift kit assembly (400B);

FIG. 53 shows various views of the lower lip engagement portion (410) of lift kit assembly (400B);

FIG. 54 shows another multi-part assembly with a lower lip engagement portion (410), and power cord channel (415);

REFERENCE TO THE NUMBERED ELEMENTS

100 lift kit assembly
104 axle cup bracket
105A axle cup attachment portion
105B frame attachment portion
106 axle cup bracket fasteners
107A frame fastener apertures
107B axle cup fastener apertures
110 frame lip engagement portion
114 frame securing member
300 motorized skateboard
302 motorized skateboard frame
303 axle
304 axle cup
305 frame to axle cup fastener
400A lift kit assembly
400B lift kit assembly
400C lift kit block
404 axle cup member
405 axle seat
406 spline/key
408 upper lip engagement portion
409 detent
410 lower lip engagement portion
411 projection
414 frame securing member
415 power cord channel
416 face portion
418 upper fastener
419 lower fastener
430 handle
500 frame

Definitions

In the following description, the term "axle cup" refers to that element of motorized skateboards that may house a radial bearing or thrust bearing at the end of a wheel axle or the end of an axle that is itself stationary relative to the axle cup, the axle supporting a motor that rotates thereabout. The axle cup typically includes a mounting means so that the axle cup is mountable to a surface. In one-wheel type motorized skateboards, a single axle for the central wheel has two ends that terminate into axle cups on either side of the wheel. The axle cups are attached to a frame that surrounds the wheel and a platform for a rider's feet is affixed to the frame. The term "axle cup support member" refers to an element that serves as an alternative mounting point for a OE axle cup or includes a combination of an axle seat and mounting point so that the axle of the original motorized skateboard may be moved to a lower position relative to the frame and thereby effectively increasing the ground to frame clearance. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references listed in this disclosure are incorporated by reference in their entirety for all purposes. In case of conflict, the present specification, including explanations of terms, will control. In addition, the materials, methods, and examples are illustrative only and not intended to be limiting.

DETAILED DESCRIPTION OF THE EMBODIMENTS

Referring generally to FIGS. 2-14, a general example implementation of a lift kit assembly (100) according to the present invention includes at least a pair of axle cup brackets (104) which are mountable to the frame (302) of a motorized skateboard (300) (FIG. 1) and which provide an alternative mounting for the original equipment right side and left side axle cups (304) such that by providing an alternate inferiorly disposed axle cup-to-frame mounting position relative to a baseline position (e.g., FIG. 1), the skateboard platform is raised and results in increased ground clearance. Alternately, the axle cup brackets may be attached to the frame (302) sides providing an alternate superiorly disposed axle cup-to-frame mounting position relative to the baseline position which results in decreased ground clearance with a lower center of gravity.

Figure 1:
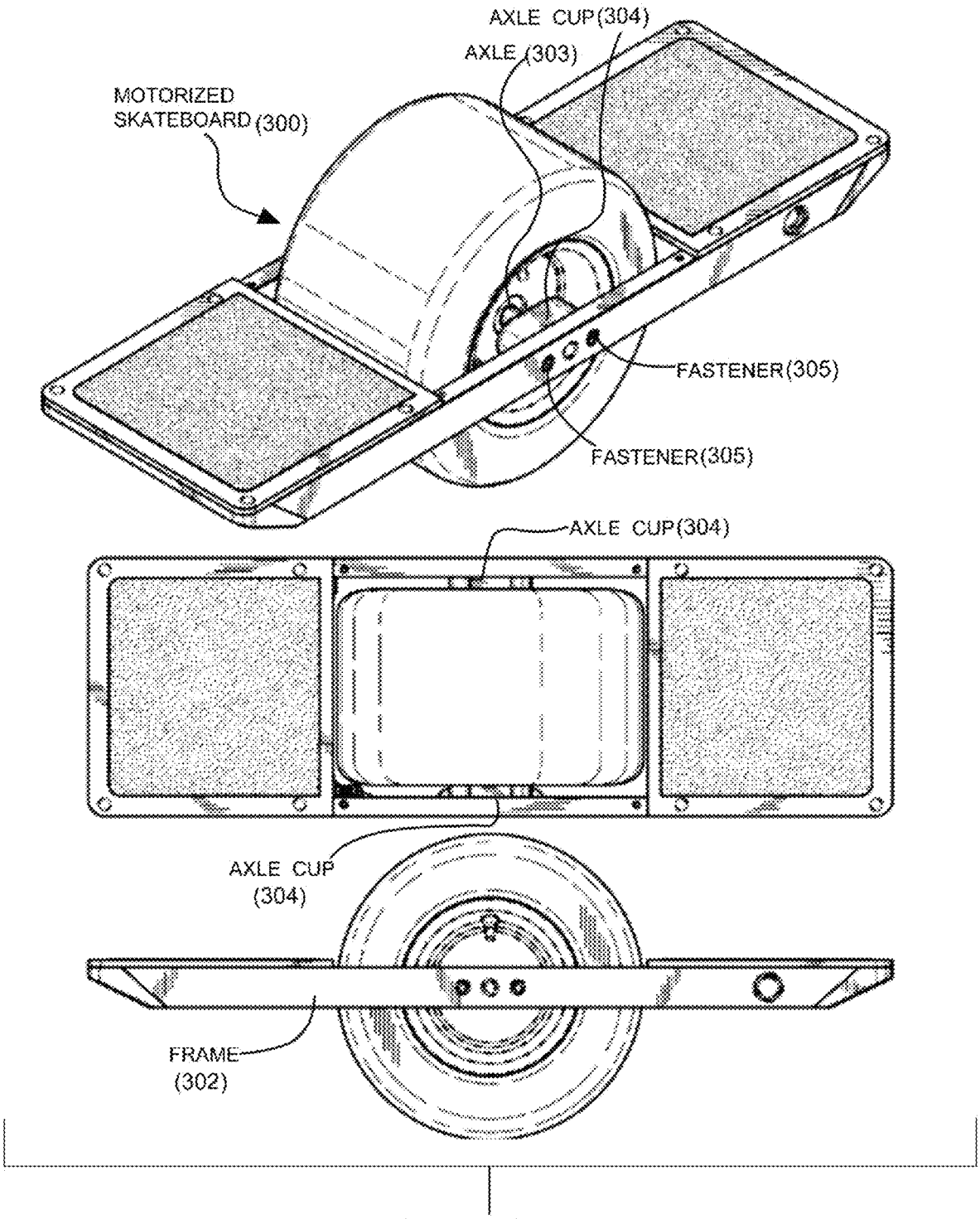
FIG. 1 PRIOR ART
FIG. 1 is a figure grouping showing respectively, a perspective view, top view and side views of a prior art motorized skateboard in a typical configuration.

FIG. 1 in order to provide a thorough explanation of the features and benefits of the present invention, includes various views of a typical prior-art motorized skateboard (300) employing a single wheel configuration and prior to any modification with components of the present invention.

Figure 2:
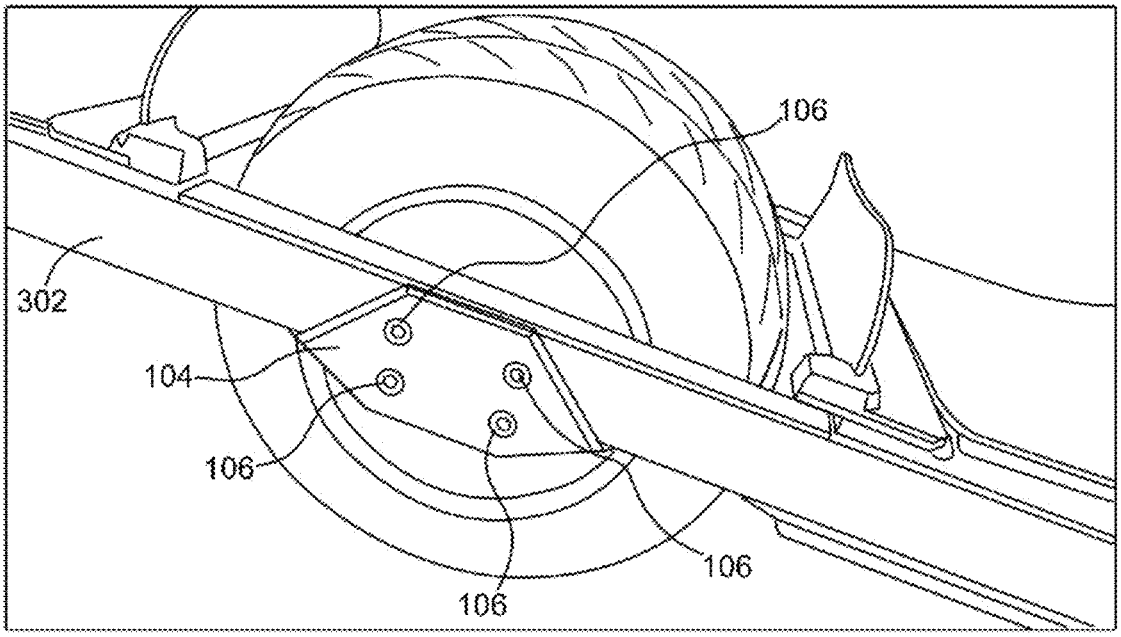
FIG. 2 is an enlarged partial perspective view showing a side section of a modified motorized skateboard similar to the one shown in (FIG. 1)

FIG. 2 is a partial perspective view showing a motorized skateboard similar to that shown in (FIG. 1), but with the addition of an example implementation of an example lift kit according to various implementations.

Figure 3:
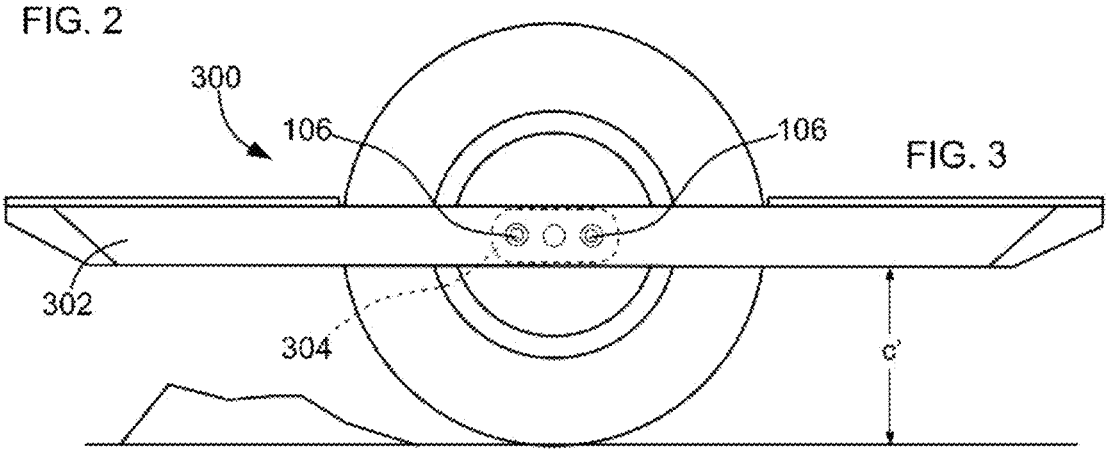
FIG. 3 shows is a side view of a motorized skateboard similar to the one shown in (FIG. 1), prior to modification.

FIG. 3 shows a motorized skateboard prior to modification and in a baseline configuration where the ground clearance is indicated by (c').

Figure 4A:
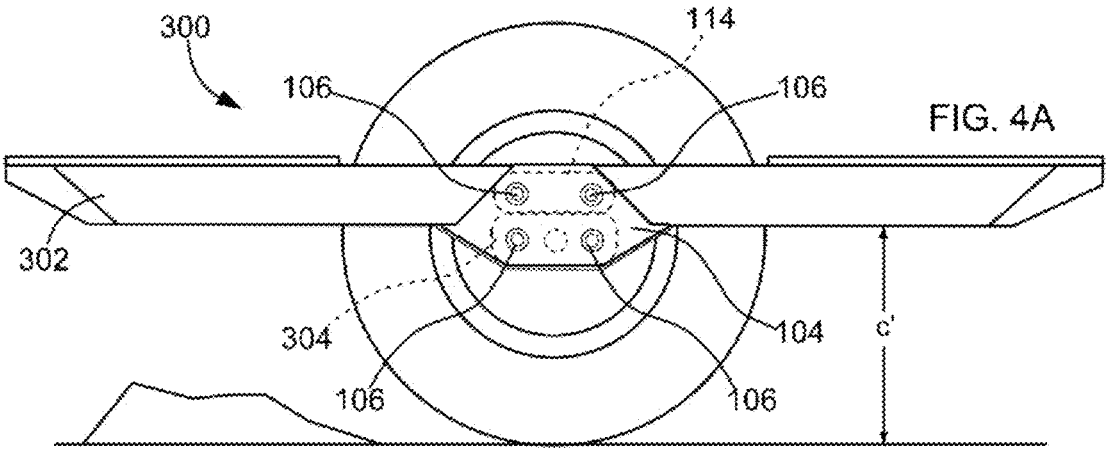
FIGS. 4A and 4B show respectively, the motorized skateboard of (FIG. 3) where an exemplary lift kit is installed in a configuration (FIG. 4A) increasing the ground clearance from the original baseline configuration (FIG. 3) or alternately, a platform lowering configuration (FIG. 4B)

FIG. 4A shows the motorized skateboard of (FIG. 3) after installation of the lift kit (100) and the new lower position for axle cup (304). Note that the OE axle cups (304) are now attached to the axle cup attachment portion (105A) of the axle cup brackets (104) rather than directly to the original frame. The axle cup brackets (104) includes apertures (107A, 107B) for threaded fasteners that align with those on the original equipment.

Figure 4B:
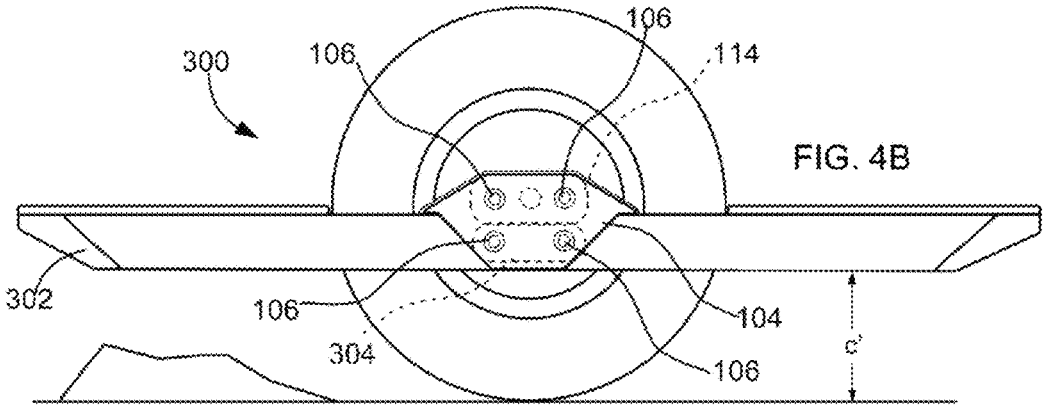
Figure 5:
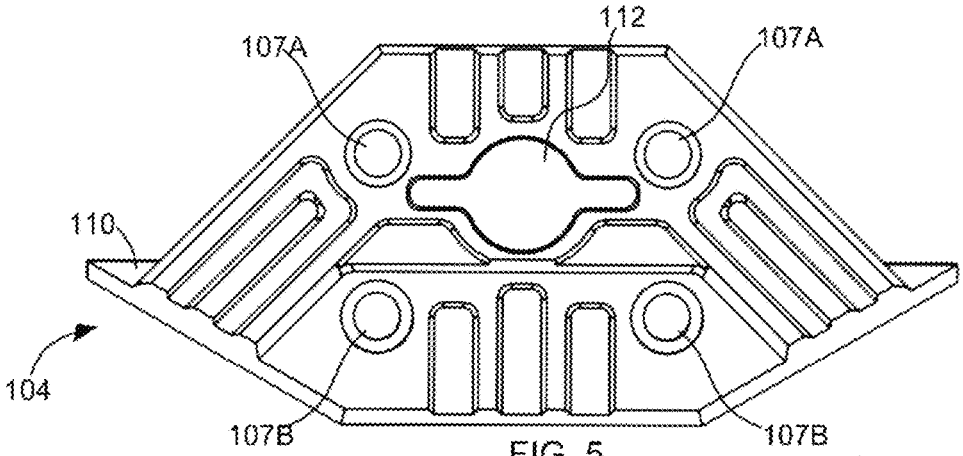
FIG. 5 is a front side view of an example lift kit assembly according to the present invention including an axle cup support member.
Figure 7:
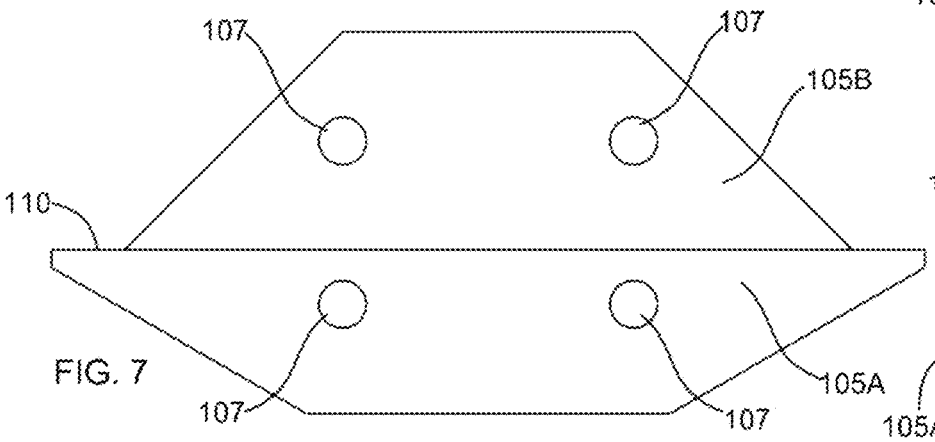
FIG. 7 is a back side view thereof.
Figure 6:
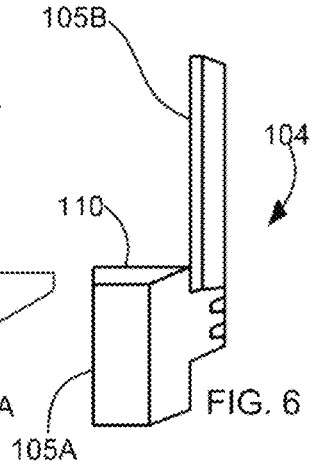
FIG. 6 is right side view thereof.
Figure 8:
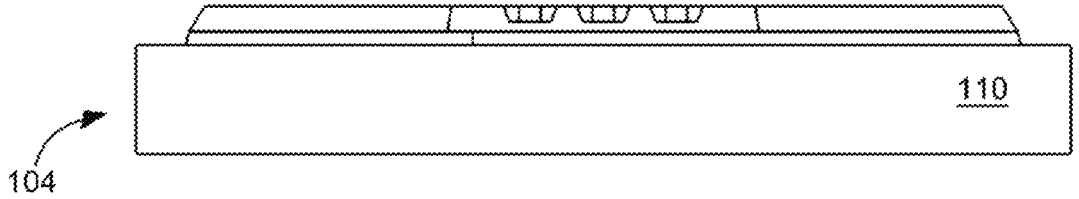
FIG. 8 is a top plan view thereof
Figure 9:
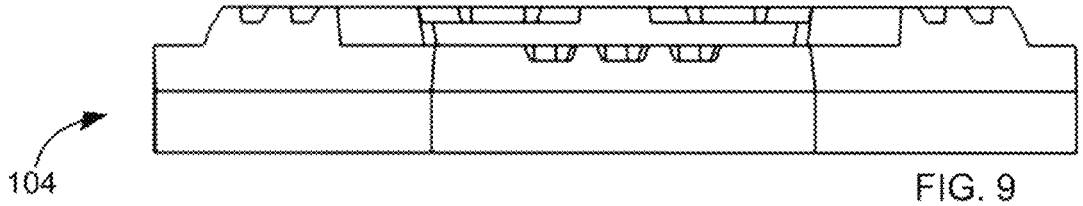
FIG. 9 is a bottom plan view thereof.
Figure 10:
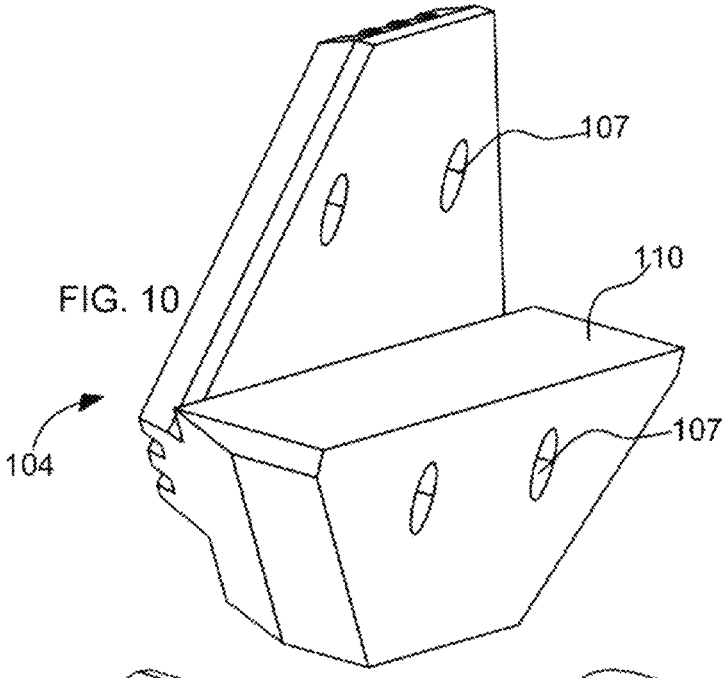
FIG. 10 is a back facing perspective view thereof.
Figure 12:
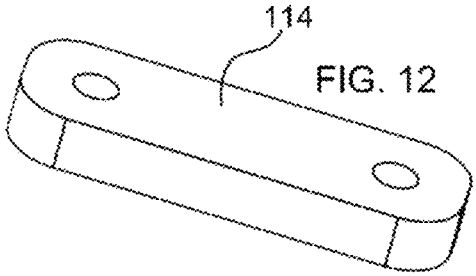
FIG. 12 is an example frame securing member with threaded apertures according to certain implementations of the present invention.
Figure 11:
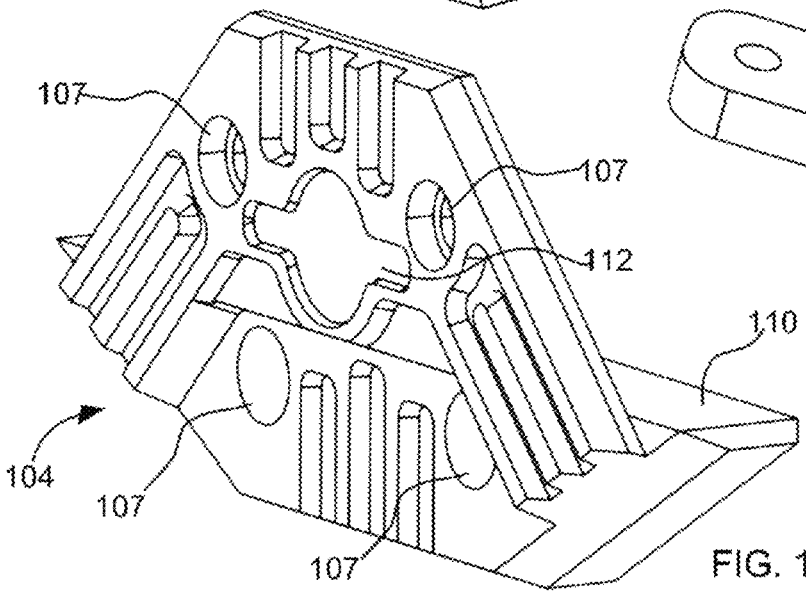
FIG. 11 is a front facing perspective view thereof.

FIG. 4B shows the motorized skateboard of (FIG. 3) after installation of the lift kit (100) and the new alternate raised mounting position for axle cup (304). Like (FIG. 4A), OE axle cups (304) are now attached to the axle cup attachment portion (105A) of the axle cup brackets (104) rather than directly to the original frame.

FIGS. 5-12 show various views of components of the lift kit assembly which include the lift kit assembly (100), axle cup bracket (104) with a frame side attachment portion (105) adapted to abut the left and right hand sides of the original frame, and a frame lip portion (110) adapted to abut a bottom side of the frame (302). Upper fastener apertures (107A) are aligned with OE frame apertures and lower fastener apertures (107B) provide new (lower) mounting points for the OE axle cup (304), and a frame securing member (114) with threaded apertures that secures the frame side attachment portion (105) of the axle cup bracket (104) to frame (302).

FIGS. 13 and 14 are perspective views showing the relationship of the various parts of the lift kit prior to installation.

Referring generally to FIGS. 15-39, in some implementations, a lift assembly (400A) which may be a bracket mounted to opposite sides of frame (500) includes an axle cup member (404) with an axle seat (405) to accept the ends of axle (303). Axle cup member (404) may be interlocked with other lift kit assembly portions that mount directly to the frame of a motorized skateboard which may have a solid rail having a rectilinear cross-section or any other profile, e.g., U-channel, C-channel, L-channel. Upper lip engagement portion (408) is configured to abut an overhang of frame rail (500) and axle cup member (404) includes a lower lip engagement portion (410). A space between the upper and lower lip engagement portions (408, 410) of the assembly defines a seat or recess for a lower lip/portion of frame rail (500) typically sandwiched between portions (408, 410). In an exploded view (FIG. 35) best shows the arrangement of the various elements. Axle cup seat (405) of axle cup member (404) is sized and shaped to accept an end of axle (303). Upper lip engagement portion (408) connects with axle cup member (404) via interlocking portions (409) which may be mating detents, prongs, ridges, indentations or other feature with which serve to align the two portions and which stabilize the assembly (400A) when frame securing member (414) is mounted to frame (500) with pass-through bolts (418). Typically an end of axle (303) is seated inside axle seat (405) and secured thereto by lower pass-through bolts (419). Assembly (400A) also includes a formed power cable channel (415) to accommodate the motor power cable (not shown) which is typically extends through the axle or adjacent to the axle to a battery, but forks and terminates with a charging port located on the frame (500).

While some implementations of a lift kit assembly may be multi-part, moving to FIGS. 40-44, a one piece lift kit block (400C) includes mounting portions for direct attachment to a frame of some motorized skateboards, and an axle seat (405) and an aperture and power cable channel (415) for routing the motor cable from the axle to frame (500) and battery and charging port.

Referring generally to FIGS. 45-54, assembly (400B) is a multi-part assembly including an axle cup member (404) an axle seat (405), a channel (415) for guiding and routing the power cable from the axle to frame (500) and a separate lower lip engagement portion (410, 416), also with a cable channel (415), that interlocks and communicates with the cable channel (415) of axle cup member (404) when the respective sections are joined. Upper lip engagement portion, similar to that shown in assembly (400A) is a separate element that abuts frame (500). Accordingly, the 3 parts (404, 414, 415) are joined to frame (500) and connected together by upper and lower fasteners (418, 419) as shown in (FIGS. 48-54).

In any of the foregoing implementations, a handle (430) of any shape form, or LED lights, such as side safety blinking lights, can be mounted to, or otherwise integrated with a lift kit assembly, typically by simply using longer bolts (419). Various implementations can be manufactured by any suitable method a from any suitable material, e.g., plastic, resin, resin composite, metals, as would suggest themselves to those having skill in the art and access to this disclosure.

Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

What is claimed is:

1. A method for increasing the ground clearance of motorized skateboards comprising the steps of:

turning the motorized skateboard upside down on a working surface;

removing frame to axle cup fasteners from sides of the motorized skateboard thereby detaching right side and left side axle cups of the motorized skateboard;

removing interfering plastic portions, if any are present, from frame sides of the motorized skateboard;

repositioning interfering cabling if any is present, from around the axle cups;

inverting a wheel assembly of the motorized skateboard as necessary to reposition cabling;

providing a pair of lift kit assemblies;

mounting each lift kit assembly to sides of the motorized skateboard via fasteners;

re-mounting each axle cup such that it is supported by a axle cup mounting portion of each axle cup bracket member;

placing the motorized skateboard in a right side up position.

2. The method according to claim 1, where the axle cups are replaced with an axle seat of the lift kit assembly.

* * * * *